US006557390B2

(12) United States Patent
Runk et al.

(10) Patent No.: US 6,557,390 B2
(45) Date of Patent: May 6, 2003

(54) PRESS BRAKE ASSEMBLIES, TOOL HOLDER APPARATUSES, AND COMPONENTS THEREOF

(75) Inventors: David M. Runk, St. Joseph, WI (US); Paul T. Johnson, Stillwater, MN (US); Richard L. Timp, Vadnais Heights, MN (US); Glen Shuldes, New Brighton, MN (US); Heath E. Harrington, Coon Rapids, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 09/852,288

(22) Filed: May 11, 2001

(65) Prior Publication Data

US 2002/0166360 A1 Nov. 14, 2002

(51) Int. Cl.[7] ..... B21D 5/02; B21D 37/04

(52) U.S. Cl. ..... 72/482.1; 72/481.1; 72/481.6

(58) Field of Search ..... 72/481.1, 481.2, 72/481.6, 481.7, 482.1, 482.2, 482.6, 481.9

(56) References Cited

U.S. PATENT DOCUMENTS

| | | | | |
|---|---|---|---|---|
| 4,535,619 A | | 8/1985 | Gargrave | 72/481 |
| 5,022,256 A | | 6/1991 | Van der Meulen | 72/481 |
| 5,390,527 A | * | 2/1995 | Kawano | 72/481.6 |
| 5,460,027 A | | 10/1995 | Takahashi | 72/481 |
| 5,507,170 A | | 4/1996 | Kawano | 72/482.91 |
| 5,511,407 A | | 4/1996 | Kawano | 72/482.91 |
| 5,513,514 A | | 5/1996 | Kawano | 72/482.91 |
| 5,572,902 A | | 11/1996 | Kawano | 72/482.91 |
| 5,619,885 A | | 4/1997 | Kawano et al. | 72/481.8 |
| 5,642,642 A | | 7/1997 | Kawano | 72/482.91 |
| 5,685,191 A | | 11/1997 | Kawano et al. | 72/482.91 |
| 5,782,308 A | | 7/1998 | Latten et al. | 72/481.6 |
| 5,794,486 A | * | 8/1998 | Sugimoto et al. | 72/481.6 |
| 6,003,360 A | | 12/1999 | Runk et al. | 72/482.2 |
| 6,138,492 A | * | 10/2000 | Vining et al. | 72/481.1 |
| 6,151,951 A | | 11/2000 | Kawano | 72/481.2 |

FOREIGN PATENT DOCUMENTS

| | | |
|---|---|---|
| EP | 0 754 506 A2 | 1/1997 |
| EP | 0 940 197 A2 | 4/1999 |
| JP | 08186135 | 2/1998 |
| JP | 11174220 | 1/2001 |

* cited by examiner

*Primary Examiner*—Lowell A. Larson
(74) *Attorney, Agent, or Firm*—Fredrikson & Byron, P.A.

(57) ABSTRACT

A tool holder apparatus for a press brake is provided. The apparatus comprises a support plate having a first receiving surface. A pivotable clamp has an engagement portion that is moveable toward the first receiving surface of the support plate by pivoting the clamp. The engagement portion has therein formed a bore in which a lifting shaft is rotatably received. The engagement portion defines an opening communicating with the bore. The shaft has therein formed a notch that is adapted to be engaged through the opening by an exterior corner of a forming tool. The notch is configured such that when the engagement portion of the clamp is forced against such tool, a first surface of the exterior tool corner bears against a first surface portion of the notch and causes the shaft to rotate within the bore, thereby bringing a second surface portion of the notch to bear against a second surface of the exterior tool corner and delivering to the tool a mounting force having a component normal to the second surface of the exterior tool corner.

29 Claims, 17 Drawing Sheets

PRESS BRAKE ASSEMBLIES, TOOL HOLDER APPARATUSES, AND COMPONENTS THEREOF

FIELD OF THE INVENTION

The present invention relates to press brakes of the type used to shape sheet-like workpieces. More particularly, this invention relates to press brake tool holders that are used to releasably retain forming tools in a press brake.

BACKGROUND

Press brakes are commonly used to shape sheet-like workpieces, such as sheet metal and the like. A conventional press brake includes an upper table and a lower table, at least one of which is movable toward and away from the other. Typically, the upper table is movable vertically, while the lower table is fixed in a stationary position. It is common for a male forming tool and a female forming die to be carried respectively by the upper and lower tables of a press brake.

Typically, the forming tool has a downwardly-oriented workpiece-deforming surface (or tip). The configuration of this surface is dictated by the shape into which it is desired to bend workpieces. The forming die has a recess that is aligned with the workpiece-deforming surface of the tool. The configuration of the recess corresponds to that of the workpiece-deforming tool surface. Thus, when the tables are brought together, a workpiece between the two is pressed by the tool into the die to give the workpiece the desired bend.

Various tool holders have been devised to mount a forming tool to the upper table of a press brake. For example, U.S. Pat. No. 5,619,885, the teachings of which are incorporated herein by reference, discloses a tool holder with a tool clamp member that is pivotally attached to a stationary support plate. During use, the clamp member exerts a clamping force upon the shank of a forming tool. To keep the tool from falling when the clamping force is released, the clamp member is provided with a projection that is engageable with a complementary drop-prevention groove formed in the tool.

In order to accurately deform workpieces, it is necessary for the forming tool to be mounted securely to the tool holder. This is accomplished by forcibly clamping the tool holder to the forming tool (i.e., by applying a clamping force to the tool). Multiple steps are typically required to operatively mount a forming tool on a conventional tool holder. This is perhaps best understood with reference to FIGS. 1–3, which illustrate a particularly useful press brake tool holder. The illustrated tool holder is disclosed in U.S. Pat. No. 6,003,360, the teachings of which are incorporated herein by reference.

As illustrated in FIG. 1, the forming tool 28 is initially mounted loosely to the tool holder 10. Specifically, the mounting tang 30 of the tool 28 is lifted upwardly between a support plate 14 and a clamp 42 of the tool holder 10. As the tool 28 is moved into the unclamped position illustrated in FIG. 1, a safety slot 122 on the tool 28 is engaged by a lip 116 of the clamp 42. Thus, the tool 28 is prevented from falling from the holder 10 by the engagement of the lip 116 and the safety slot 122. Although the tool 28 is retained loosely by the holder 10 in this position, it is not operatively clamped therein. Specifically, the load-bearing surfaces 24, 26 of the support plate 14 and forming tool 28 are not brought into secure engagement with one another by simply mounting the tool 28 in its unclamped position. Rather, additional steps are required to mount the tool 28 in its operative position.

The upper and lower tables of the press brake are subsequently moved together until the forming tool comes into contact with a forming die on the lower table. This is best understood with reference to FIG. 2, wherein the tip 38 of the loosely-mounted tool 28 has been moved into engagement with a forming die 168 on the lower table (not shown). By forcing the tip 38 of the tool 28 against the die 168, the tool 28 is urged upwardly relative to the tool holder 10 until the load-bearing surface 26 of the tool 28 is moved into contact with the load-bearing surface 24 of the support plate 14.

At this point, the tool 28 can be forcibly clamped (or locked) in its operative position. While maintaining the tool 28 in the position shown in FIG. 2, the lower portion 68 of the clamp 42 is pivoted toward the tool 28. As this portion 68 of the clamp 42 closes upon the shank 30 of the tool 28, the tool is clamped securely to the holder. FIG. 3 illustrates the resulting operative position, wherein the load bearing surfaces 24, 26 of the support plate 14 and the tool 28 are engaged and the mounting shank 30 of the tool 28 is forcibly clamped between the support plate 14 and the lower portion 68 of the clamp 42. During operation, the tool holder 10 is locked in this clamped position. Thus, it can be seen that several steps are typically required to operatively mount a forming tool upon a tool holder.

It would be desirable to provide a tool holder that can be operatively clamped about a forming tool in such a way that the load-bearing surfaces of the tool and the holder are engaged as an adjunct of the clamping action of the tool holder (i.e., without having to press the tip of the loosely-clamped tool against a die on the lower table of the press brake).

SUMMARY OF THE INVENTION

A tool holder apparatus for a press brake is provided in a first embodiment of the present invention. The apparatus comprises a support plate having a first receiving surface. A pivotable clamp has an engagement portion that is moveable toward the first receiving surface of the support plate by pivoting the clamp. The engagement portion has therein formed a bore in which a lifting shaft is rotatably received. The engagement portion defines an opening communicating with the bore. The shaft has therein formed a notch that is adapted to be engaged through the opening by an exterior corner of a forming tool. The notch is configured such that when the engagement portion of the clamp is forced against such tool, a first surface of the exterior tool corner bears against a first surface portion of the notch and causes the shaft to rotate within the bore, thereby bringing a second surface portion of the notch to bear against a second surface of the exterior tool corner and delivering to the tool a mounting force having a component normal to the second surface of the exterior tool corner.

In another aspect of the invention, there is provided a tool holder assembly for a press brake. The assembly comprises a support plate having a first receiving surface and a load-bearing receiving surface. A forming tool has a first mounting surface on a first side thereof and an exterior corner (i.e., an exterior tool corner) on a second side thereof. The first mounting surface of the tool is engaged with the first receiving surface of the support plate. The tool has a load-bearing mounting surface forming an included right angle with the first mounting surface. The load-bearing mounting surface is adapted to engage the load-bearing surface of the support plate. A pivotable clamp has an engagement portion that is moveable toward the first receiving surface by pivoting the clamp. The engagement portion has therein formed a bore in which a lifting shaft is rotatably received. The engagement portion defines an opening communicating with the bore. The shaft has therein formed a notch that is adapted to be engaged through the opening by the exterior corner of the forming tool. The notch is configured such that when the engagement portion of the clamp is forced against the tool, a first surface of the exterior tool corner bears against a first surface portion of the notch and causes the shaft to rotate within the bore, thereby bringing a second surface portion of the notch to bear against a second surface of the exterior tool corner. Thus, delivering to the tool a mounting force having a component normal to the second surface of the exterior tool corner.

In still another aspect of the invention, there is provided an upper press brake assembly. The assembly comprises an upper press brake table including a tool holder body. A support plate forms part of the tool holder body and has a first receiving surface and a generally downward-facing load-bearing receiving surface. The receiving surfaces of the support plate together define an exterior corner. A forming tool has a first mounting surface on a first side thereof and an exterior corner (i.e., an exterior tool corner) defined by first and second corner surfaces on a second side thereof. The second corner surface is generally-downwardly-facing. The first mounting surface of the tool is engaged with the first receiving surface of the support plate. The tool has a load-bearing mounting surface forming an included angle with the first mounting surface and being adapted to engage the generally downward-facing load-bearing receiving surface of the support plate. A clamp is attached pivotally to the tool holder body and has an engagement portion that is moveable toward the first receiving surface by pivoting the clamp. The engagement portion has therein formed a bore in which a lifting shaft is rotatably received. The engagement portion defines an opening communicating with the bore. The shaft has therein formed a notch that is adapted to be engaged through the opening by the exterior corner of the tool. The notch is configured such that when the engagement portion of the clamp is forced against the tool, the first corner surface bears against a first surface portion of the notch and causes the shaft to rotate within the bore, thereby bringing a second surface portion of the notch to bear against the second corner surface. Thus, delivering to the tool a mounting force having a generally-upward component.

A tool holder apparatus for a press brake is provided in yet another aspect of the invention. The apparatus comprises a support plate having a first receiving surface and a generally downward-facing receiving surface. These receiving surfaces together define an exterior corner. A pivotable clamp has an engagement portion that is moveable toward the first receiving surface by pivoting the clamp. The engagement portion has therein formed a bore in which a lifting shaft is rotatably carried. The engagement portion defines a slot communicating with the bore. The shaft has therein formed a notch that is adapted to be engaged through the slot by an exterior corner of a forming tool a mounting tang of which is positioned between the first receiving surface of the support plate and the engagement portion of the clamp. The notch is configured such that when the engagement portion of the clamp is forced against such tool, a generally-vertical surface of the exterior corner bears against a first surface portion of the notch and causes the shaft to rotate within the bore, thereby bringing a second surface portion of the notch to bear against a generally-downward-facing surface of the exterior corner and delivering to the tool a mounting force having a generally-upward component.

A tool holder apparatus for a press brake is provided in still another aspect of the invention. The apparatus comprises a support plate having a first receiving surface. A clamp has an engagement portion defining a slot communicating with a bore formed in the clamp. A lifting shaft is rotatably received in the bore. The shaft has therein formed a notch that can be engaged through the slot by an exterior corner of a forming tool. The notch is configured such that when it is forced against the exterior corner, a first surface of the exterior corner bears against a first surface portion of the notch and causes the shaft to rotate within the bore, thereby bringing a second surface portion of the notch to bear against a second surface of the exterior corner. Thus, delivering to the tool a mounting force having a component normal to the second surface of said exterior corner.

In yet another aspect of the invention, there is provided a press brake assembly. The assembly comprises an upper press brake table including a tool holder body and a lower press brake table including a forming die. A support plate forms part of the tool holder body and has a first receiving surface and a load-bearing receiving surface. These receiving surfaces together form an exterior corner. A forming tool has a first mounting surface on a first side thereof and an exterior corner defined by first and second corner surfaces on a second side of the tool. The first mounting surface is engaged with the first receiving surface of the support plate. The tool has a load-bearing mounting surface forming an included angle with the first mounting surface. The load-bearing mounting surface is adapted to engage the load-bearing surface of the support plate. The tool has a workpiece-deforming surface oriented downwardly toward the forming die. A clamp is attached pivotally to the tool holder body and has an engagement portion that is moveable toward said first receiving surface by pivoting the clamp. The engagement portion has therein formed a bore in which an elongated shaft is rotatably received. The engagement portion defines an opening communicating with the bore. The shaft has therein formed a notch that is adapted to be engaged through the opening by the exterior corner of the tool. The notch is configured such that when the engagement portion of the clamp is forced against the tool, the first corner surface bears against a first surface portion of the notch and causes the shaft to rotate within the bore, thereby bringing a second surface portion of the notch to bear against the second corner surface and delivering to the tool a mounting force having a component normal to the second corner surface. Thus, the load-bearing surfaces can be engaged with one another by forcing the engagement portion of the clamp against the tool without forcing the workpiece-deforming surface of the tool against the forming die on the lower table.

DETAILED DESCRIPTION OF THE PREFERRED EMBODIMENT

Figure 1:
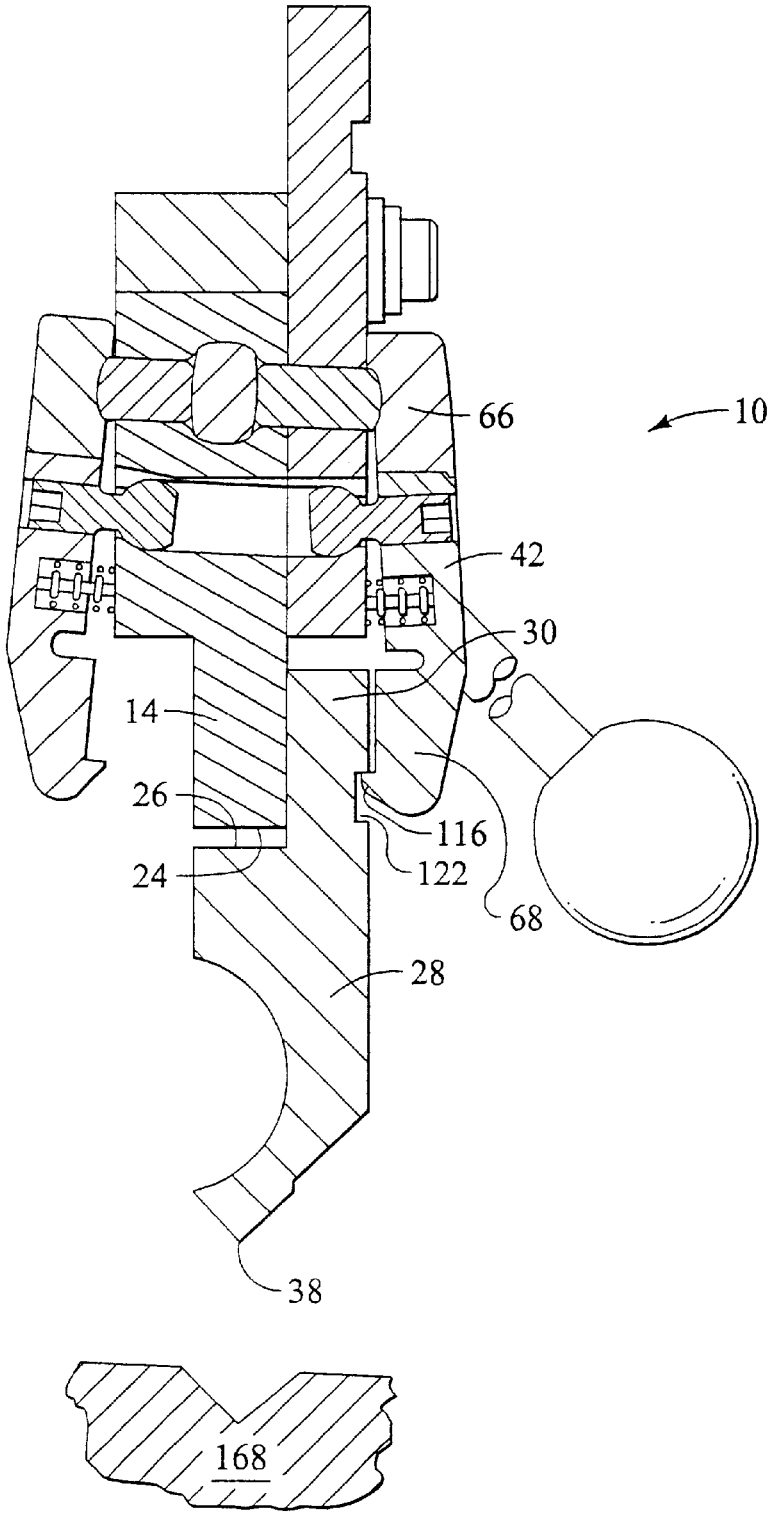
FIG. 1 PRIOR ART
FIG. 1 is a cross-sectional end view of a prior art tool holder depicted in its unclamped position.
Figure 2:
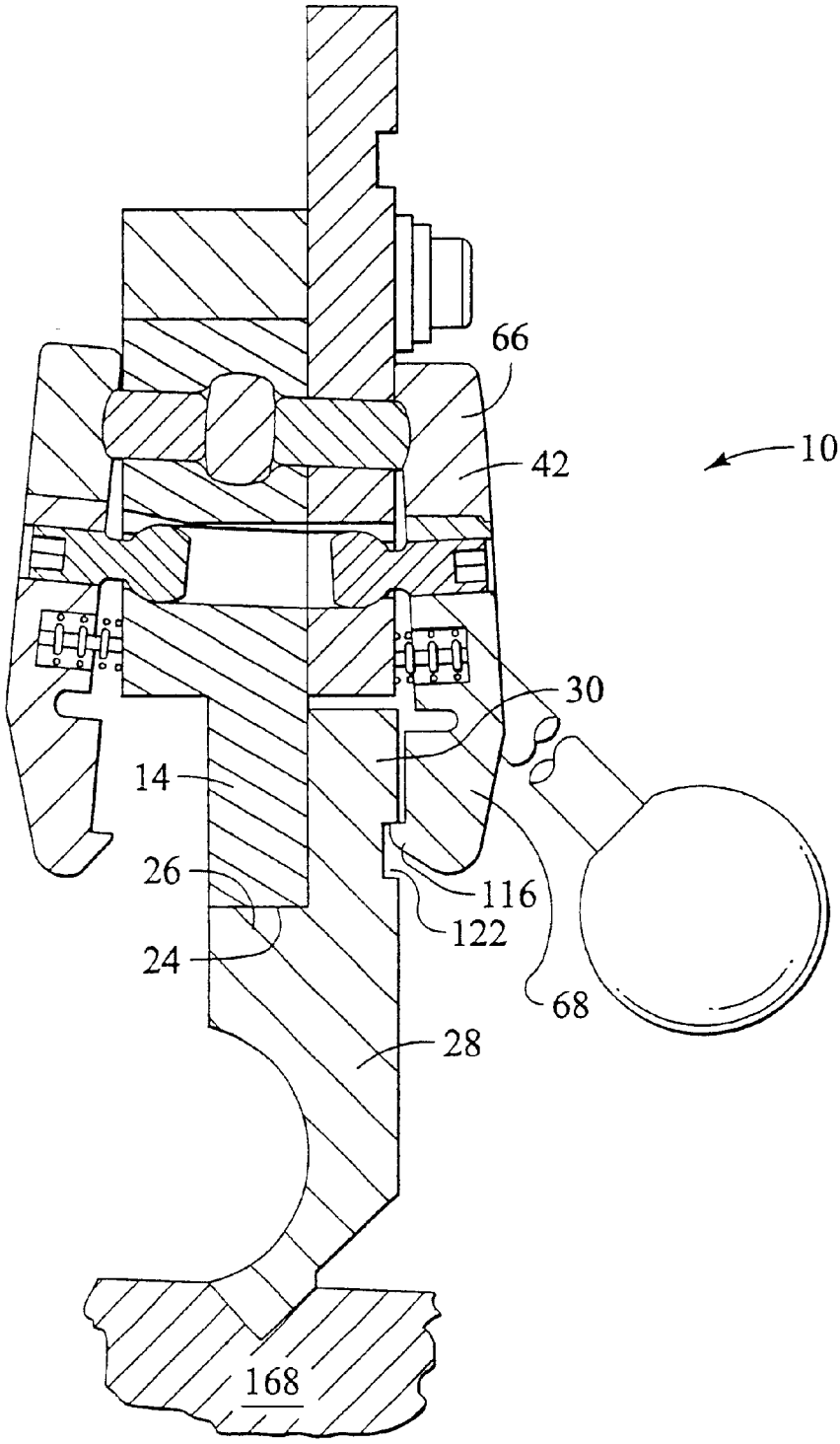
FIG. 2 PRIOR ART
FIG. 2 is a cross-sectional end view of the unclamped tool holder of FIG. 1 in which the tool holder is depicted in engagement with a forming die.
Figure 3:
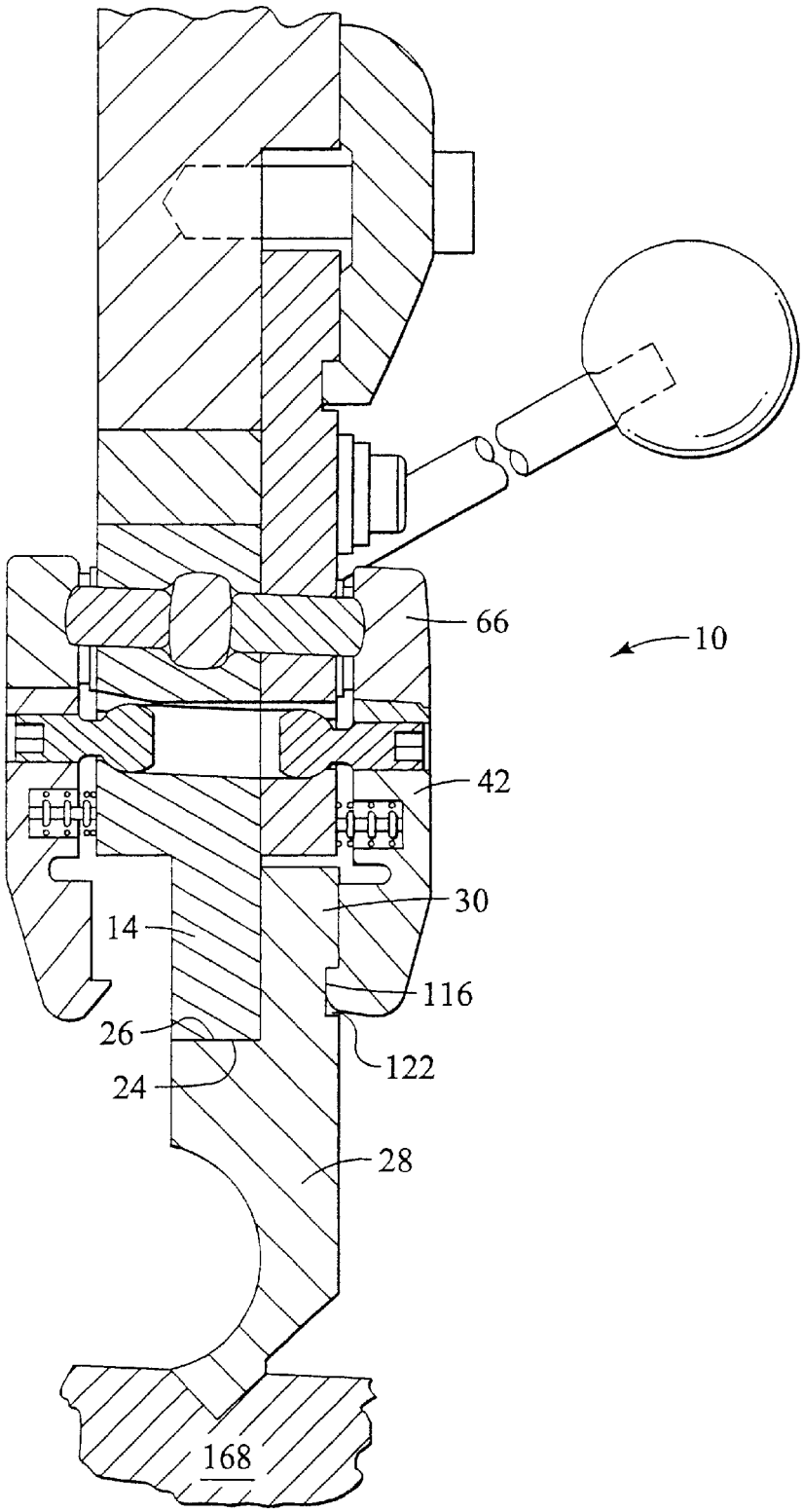
FIG. 3 PRIOR ART
FIG. 3 is a cross-sectional end view of the tool holder of FIG. 1 in which the tool holder is depicted in its clamped position.
Figure 4:
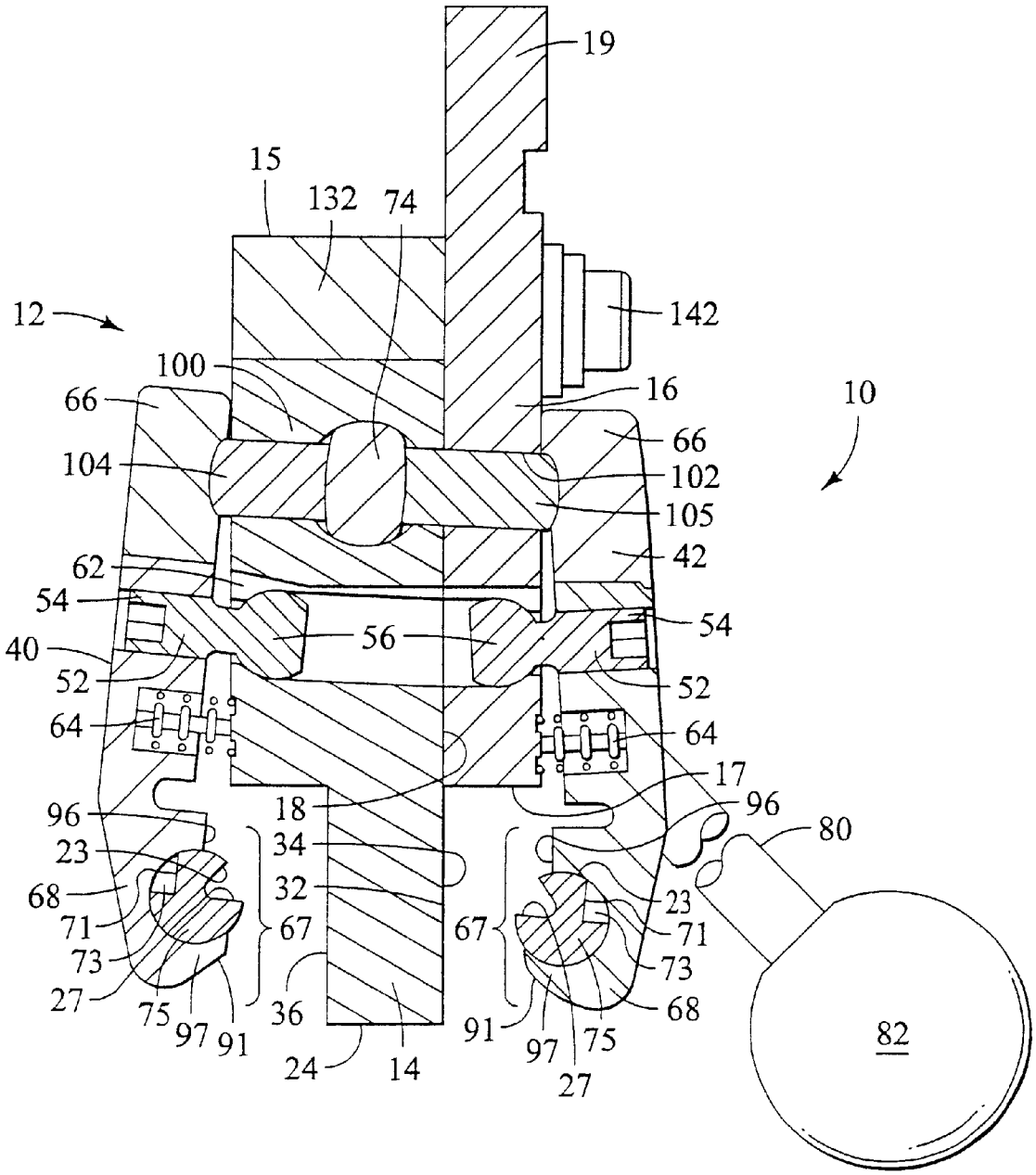
FIG. 4 is a cross-sectional end view of a tool holder in accordance with one embodiment of the present invention.

FIG. 4 illustrates a tool holder 10 in accordance with a preferred embodiment of the present invention. The illustrated tool holder 10 is not carrying a forming tool (i.e., the holder is depicted in an unloaded position). The tool holder 10 generally includes a holder body 12 and at least one clamp 42. As is typical, the illustrated tool holder 10 includes two clamps 40, 42 mounted on opposite sides of the holder body 12. However, the tool holder can alternatively be provided with a single clamp, as discussed below.

The tool holder 10 shown in FIG. 4 has a composite holder body 12. That is, the holder body 12 is an assembly of multiple plates. Specifically, the illustrated holder body 12 includes a support plate 14 to which is joined a mount plate 16. The support plate 14 and the mount plate 16 have generally vertical surfaces 18, 20, respectively, that are contiguous (i.e., abutting). When a composite holder body 12 of this nature is employed, the mount plate 16 can be joined to the support plate 14 by any desired fastening means. For example, they can be joined together by one or more threaded bolts (not shown). A variety of other conventional fasteners can also be used.

Figure 5A:
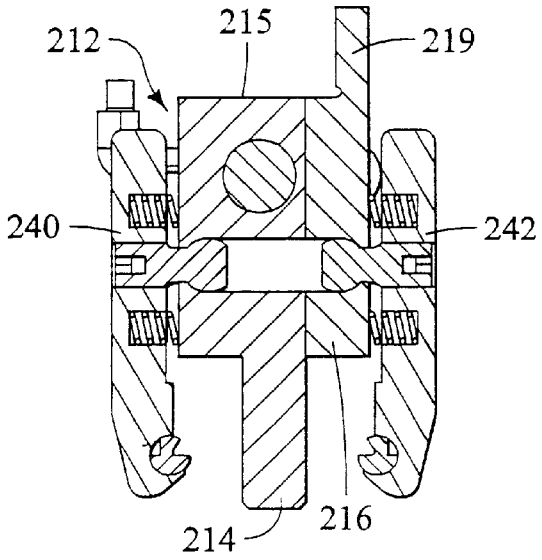
FIG. 5A is a cross-sectional end view of a tool holder in accordance with another embodiment of the invention.
Figure 5B:
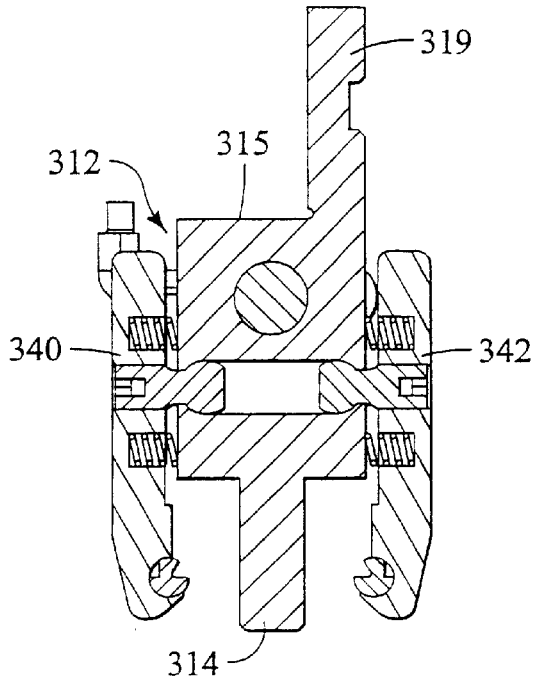
FIG. 5B is a cross-sectional end view of a tool holder in accordance with still another embodiment of the invention.
Figure 5C:
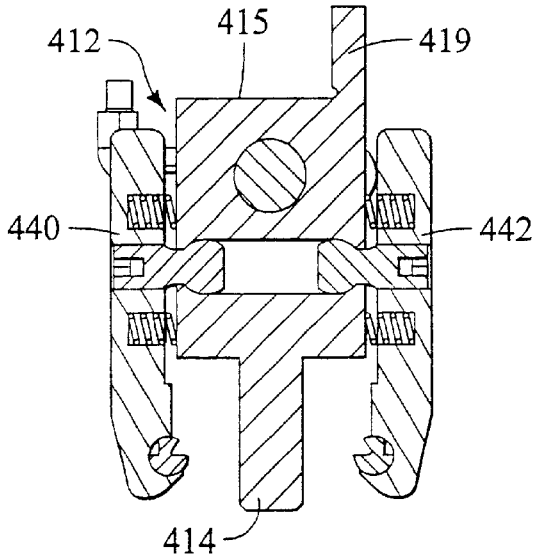
FIG. 5C is a cross-sectional end view of a tool holder with yet another embodiment of the invention.

While FIG. 4 illustrates a particularly useful composite holder body 12, the present invention does not require a holder body of any particular structure. For example, FIG. 5A illustrates another particularly useful holder body 212, which has a slightly different structure than that shown in FIG. 4. This body 212 is also an assembly of multiple plates. It is noted that the reference numerals in FIGS. 5A, 5B, and 5C are indexed respectively by factors of 200, 300, and 400 over the reference numerals that identify analogous features in FIG. 4. With reference to FIG. 5A, a mount plate 216 is joined to a support plate 214 in much the same manner as depicted in FIG. 4. However, the mount plate 216 shown in FIG. 5A has a slightly different configuration than that of FIG. 4. Specifically, the upper end 219 of the mount plate 216 shown in FIG. 5A is not as wide as the upper end 19 of the mount plate 16 shown in FIG. 4. This provides a wider horizontal surface 215 against which the beam of an upper press brake table (not shown) can be mounted.

While FIGS. 4 and 5A illustrate composite tool holder bodies, the present invention is by no means limited to use with a holder body formed of multiple plates. For example, the holder body can be formed of a single plate. FIG. 5B illustrates one such embodiment, wherein the holder body 312 is formed of an integrally-constructed plate 314. The configuration and relative dimensions of this holder body 312 are similar to those of the holder body 12 shown in FIG. 4. For example, the holder body 312 has an upper extension 319 configured and dimensioned much like the upper end 19 of the mount plate 16 shown in FIG. 4. This extension 319 forms an included right angle together with the upper surface 315 of the holder body 312, hence facilitating mounting of the tool holder to an upper press brake table.

FIG. 5C illustrates yet another holder body that is useful with the present invention. This holder body 412, like that shown in FIG. 5B, is formed of a single plate 414. However, the configuration and relative dimensions of this holder body 412 are similar to those of the holder body 212 in FIG. 5A. For example, the upper extension 419 of the holder body 412 has the same relative width as the upper end 219 of the mount plate 216 shown in FIG. 5A. Of course, those skilled in the art would readily appreciate a variety of other body structures that would be useful with the present invention.

Regardless of the particular structure of the holder body, the tool holder includes a shoulder extending from the holder body. For example, the support plate shown in FIG. 4 includes a downward-facing shoulder that is adapted to engage an upward-facing shoulder of a forming tool (not shown). The downward-facing shoulder of the support plate 14 terminates in a load-bearing receiving surface 24. This surface 24 of the support plate 14 is adapted to deliver downward force to a forming tool operatively mounted to the tool holder. As is discussed below in further detail, the load-bearing surface 24 of the support plate 14 is desirably maintained flush against a load-bearing surface of the forming tool during operation of the press brake. If so desired, the downwardly facing shoulder 17 can additionally, or alternatively, be employed as a load bearing surface.

The support plate 14 includes a first receiving surface 34 against which the mounting shank of a forming tool can be positioned. As illustrated in FIG. 4, the first receiving surface 34 arises along the front side (i.e., the side oriented toward the handle 82) of the downward-facing shoulder of the support plate 14. This receiving surface 34 forms an exterior corner together with the load-bearing surface 24 of the support plate 14. In further detail, the first receiving surface 34 is typically a generally vertical surface that defines a normal exterior corner with the load-bearing receiving surface 24. Accordingly, the load-bearing receiving surface 24 is typically a generally horizontal, downward-facing surface.

With continued reference to FIG. 4, receiving surfaces 34, 36 arise along both sides of the downward-facing shoulder of the support plate 14. Thus, a forming tool can be mounted on the tool holder 10 in two different positions. Specifically, a tool can be clamped either between the first clamp 42 and the first receiving surface 34, or between the second clamp 40 and the second receiving surface 36. As noted above, however, the tool holder 10 can alternatively be provided with a single clamp by simply omitting one of the clamps or by redesigning the tool holder such that only one side of the support plate has a useful vertical receiving surface. Variations of this nature will be obvious to those skilled in the art.

Figure 6:
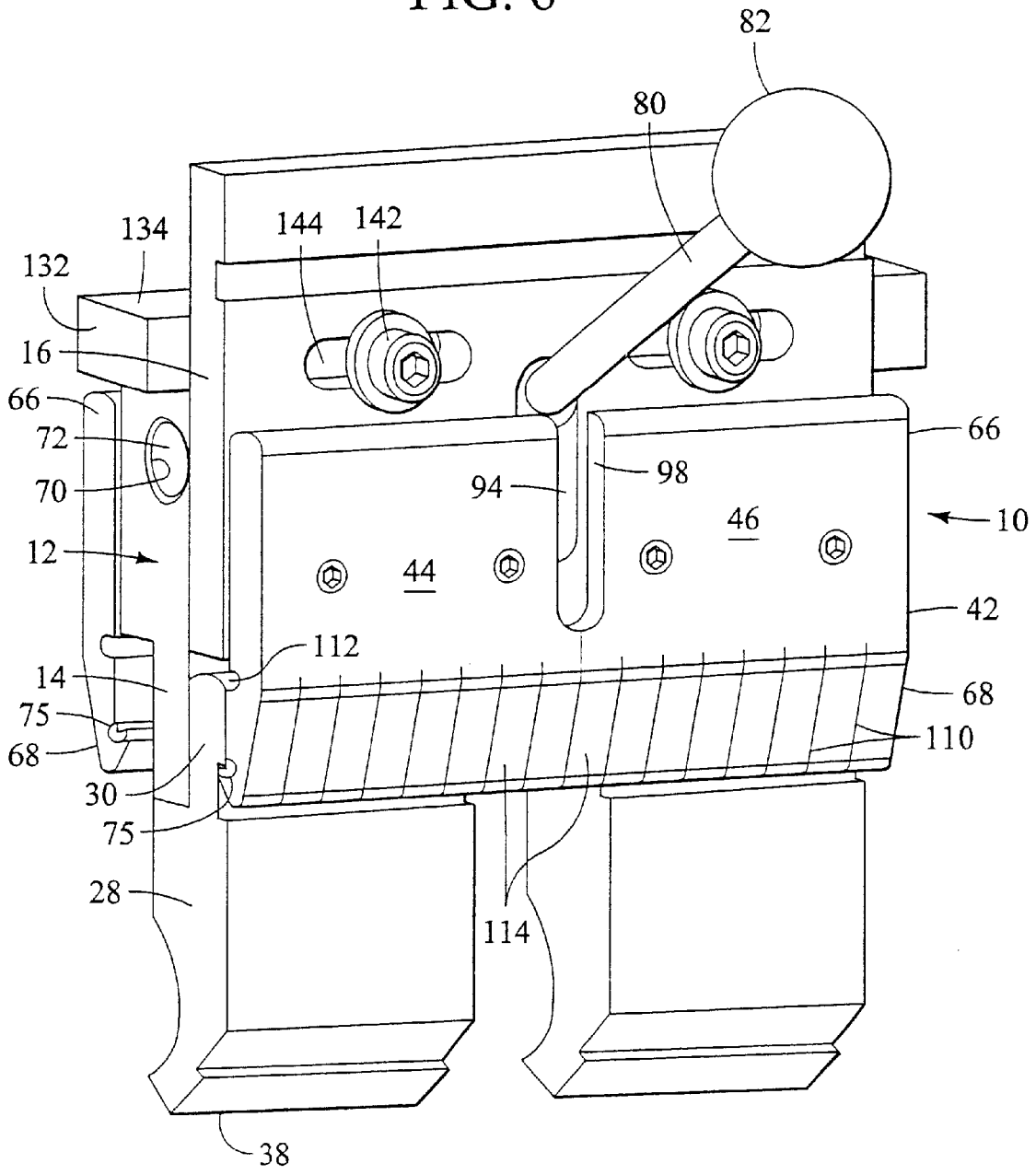
FIG. 6 is a perspective of a tool holder with attached tooling in accordance with still another embodiment of the invention.

The tool holder includes at least one clamp that is adapted to forcibly retain the shank of a forming tool against the support plate. As noted above, the tool holder will typically be provided with two clamps mounted on opposite sides of the holder body. For example, with reference to FIG. 4, the first clamp 42 (i.e., the clamp on the front side of the tool holder) is mounted to the mount plate 16, while the second clamp 40 is mounted to the support plate 14. Each clamp is advantageously formed of two half units. This is perhaps best understood with reference to FIG. 7, which illustrates an exploded view of a preferred tool holder of the invention. In further detail, the first clamp 42 is composed of a first unit half 44 and a second unit half 46, and the second clamp 40 is composed of a first unit half 48 and a second unit half 50. FIG. 6 illustrates the resulting assembly of the tool holder 10.

In the preferred embodiment illustrated in FIG. 4, each clamp has an upper portion 66 and a lower portion 68 and is pivotally attached therebetween to the holder body 12. For example, the first clamp 42 is pivotally attached to the holder body 12 in such a way that the engagement portion 67 of the clamp 42 is moveable selectively toward or away from the first receiving surface 34 of the support plate 14. As discussed below, this is accomplished by pivoting the clamp 42, either in the clockwise direction (as seen in FIG. 4) to move the lower end 68 of the clamp 42 toward the support plate 14, or in the counterclockwise direction to move the lower end 68 of the clamp 42 away from the support plate 14. Thus, the engagement portion 67 of the clamp 42 is adapted to contact the mounting shank of a tool (not shown) when the tang of such tool is positioned between support plate 14 and the clamp 42.

Preferably, each clamp is attached pivotally to the tool holder body 12. In particularly preferred embodiments, each clamp is pivotally attached to the holder body 12 by a plurality of pins 52, each extending from the clamp and terminating in an enlarged head 56 received in a recess defined by the holder body 12, or vice versa. That is, each pin 52 can alternatively extend from the holder body 12 and terminate in a recess defined by the clamp. Either way, the enlarged heads 56 and the respective recesses are shaped so as to articulate together when the clamp is made to pivot.

Figure 7:
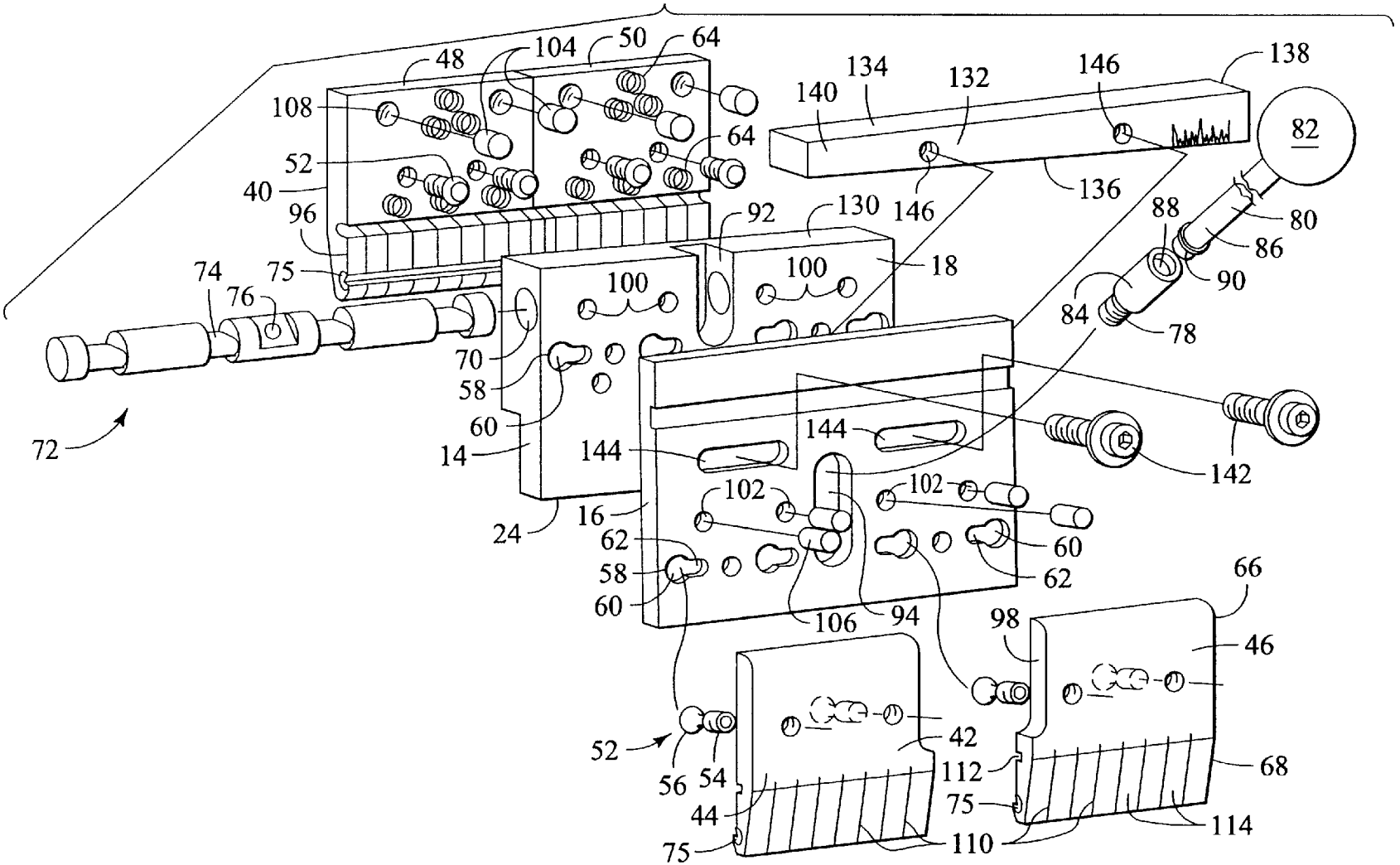
FIG. 7 is an exploded perspective view of the tool holder of FIG. 6.

The former arrangement is illustrated in FIG. 7, wherein each clamp half unit is provided with a pair of spaced-apart pins 52. Each pin 52 has a threaded end 54 that is received in a threaded bore formed in the clamp. Each pin 52 also has an enlarged, rounded head 56 that is received in a slotted aperture defined by the holder body 12. With continued reference to FIG. 7, the mount plate 16 and the support plate 14 each include a plurality of spaced-apart apertures 58 that are aligned horizontally to define an axis about which the first 42 and second 40 clamps are respectively adapted to pivot. Each aperture 58 forms a horizontally elongated slot having an enlarged end opening 60 and an undercut slot portion 62. The enlarged heads 56 of the pins are sized so as to be received through the enlarged end openings 60 of the slots. When in this position, the individual clamps can be moved horizontally toward the center line of the tool, thus sliding the enlarged heads into engagement with the undercut surfaces 62 of the slots. In this manner, each clamp half can be released from the tool holder by sliding the clamp half horizontally away from the center of the tool until the pins are aligned with the enlarged openings 60, whereupon the clamp halves can simply be removed from the holder body.

A series of compression springs 64 are advantageously mounted between the confronting surfaces of each clamp and the holder body. These springs 64 tend to urge the clamps away from the holder body so that each clamp is tethered to the body by the pins 52. The confronting surfaces of each clamp and the holder body are provided with seating recesses to receive and support the ends of the springs. With respect to the embodiment of FIG. 4, the pins 52 separate each clamp into an upper portion 66 and a lower portion 68. Thus, when the upper portion 66 of a clamp is moved away from the holder body 12, the lower portion 68 of the clamp is conjointly moved toward the holder body 12. This pivoting occurs about the axes defined by the centers of the enlarged pin heads 56.

Any desired actuator can be used to cause a clamp of the present invention to pivot. As is perhaps best seen in FIG. 7, a preferred actuator mechanism involves a cam shaft. In more detail, a horizontal bore 70 is formed through the length of the support plate 14. Rotatably fitted within the bore 70 is a cam shaft 72. The cam shaft 72 has a generally circular cross section along its length and includes spaced camming sections, which can be oval or generally elliptical as shown at 74. The midsection of the cam shaft is provided with a flat surface having a bore 76 threaded to receive the threaded end 78 of a handle 80. With continued reference to FIG. 7, the handle 80 preferably comprises a composite handle assembly. For example, the illustrated handle assembly includes a manually-operable knob 82 at one end, an exteriorly threaded end portion 78 on a handle segment 84 at the opposite end, and an intermediate shaft portion 86 that is telescopically received within a bore 88 in the handle segment 84. The intermediate shaft portion 86 is preferably releasably held in the bore 88 by a resilient O-ring 90. In the illustrated embodiment, the support plate 14 is provided with a central, vertical slot 92 at its upper edge such that when the cam shaft is fully received within the bore 70 and the threaded end 78 of the handle is received in the threaded hole 76, the handle can be moved upwardly and downwardly through the slot 92. Likewise in the illustrated embodiment, an elongated slot 94 is formed through the thickness of the mount plate 16 in alignment with the slot 92. The handle 80 passes through the slot 94, which allows the handle to be moved easily between a lower position (shown in FIG. 8) and an upper position (shown in FIG. 10), the handle being thus moved in a plane perpendicular to the axis of the cam shaft 72. The half units 44, 46 of the illustrated first clamp 42 have confronting recessed surfaces 98 that define an upwardly open slot on the front of the tool holder 10 when the half units are joined, thus enabling motion of the handle in the manner just described.

Figure 8:
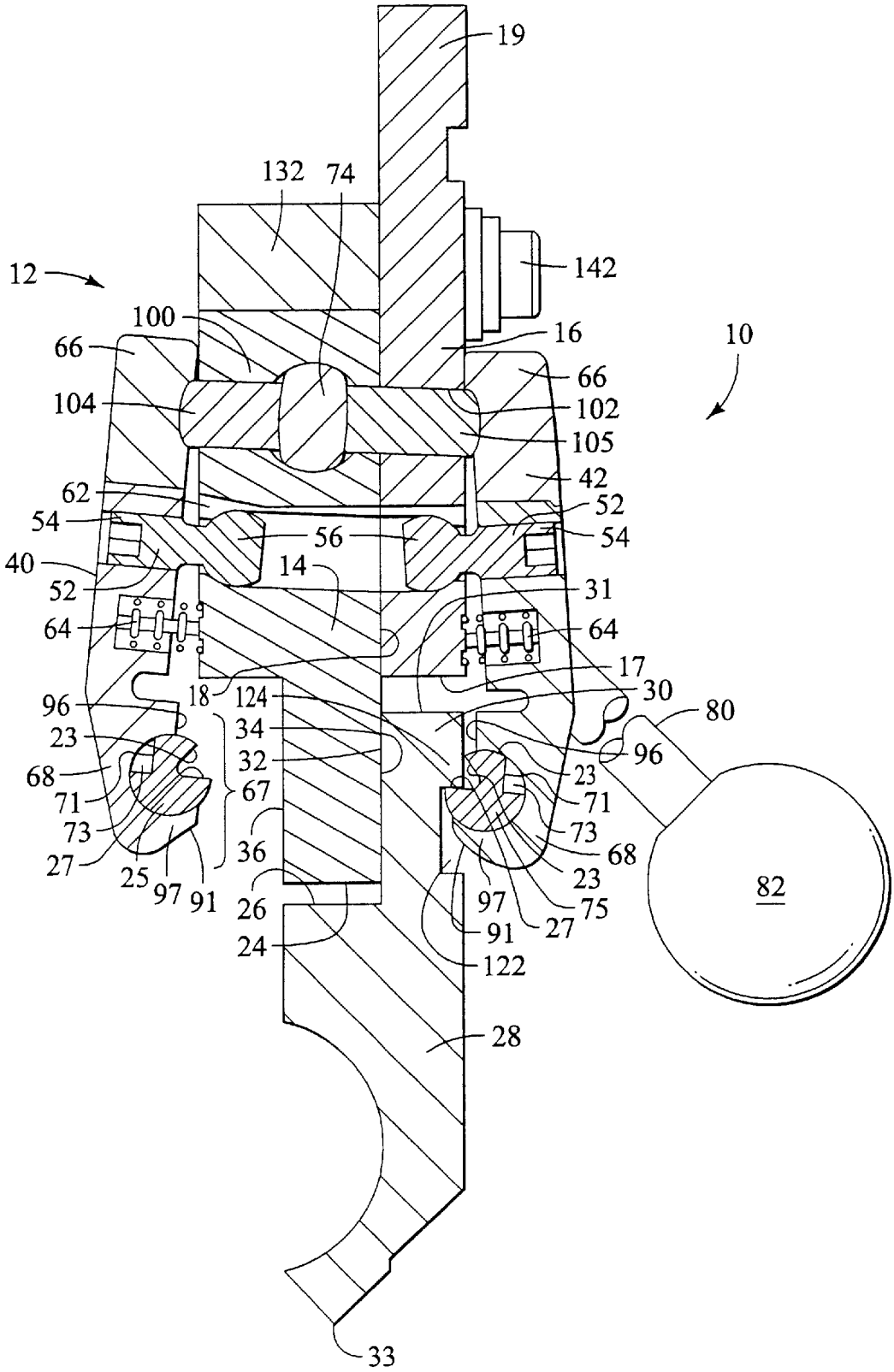
FIG. 8 is a cross-sectional end view of the tool holder of FIG. 4 in which the tool holder is depicted in an unclamped position about a forming tool.

With reference to the embodiment of FIGS. 6–8, it can be seen that aligned bores are formed transversely through the thickness of the support plate 14 and mount plate 16. These bores intersect the bore 70 in which the cam shaft 72 is received. These transverse bores are in line with the portions of the cam shaft that include the camming surfaces 74. The transverse bores formed in the support plate are designated by the reference numeral 100, and those in the mounting plate by the reference numeral 102. Within the transverse bores are positioned sliding cam follower pins that extend between the camming sections 74 of the cam shaft and the upper portions of the clamps. The cam follower pins between the cam shaft and the clamp 40 are designated 104 and the cam follower pins between the cam shaft and the clamp 42 are designated 106. Preferably, the ends of the cam follower pins that engage the oval camming surfaces of the cam shaft are slightly concave, whereas the outer ends of the cam follower pins are preferably slightly convex so as to engage hemispherical recesses 108 formed in the confronting surfaces of the clamps.

As noted above, there is provided at least one clamp having an engagement portion that is moveable toward the support plate and is adapted to engage the tang of a forming tool positioned against the support plate. In embodiments of the invention wherein each clamp has an upper portion 66 and a lower portion 68 and is attached pivotally therebetween to the holder body 12, the engagement portion 67 of each clamp will typically be on the lower portion 68 of the clamp. In the embodiment of FIG. 4, the engagement portion 67 of the clamp 42 includes a contact surface 96 that is adapted to bear against the mounting shank of a forming tool (not shown) positioned between the clamp and the downwardly-extending shoulder of the support plate 14.

The engagement portion 67 of at least one of the clamps has therein formed a bore 93 that is adapted to rotatably receive a lifting shaft 75. As is perhaps best understood with reference to FIGS. 12 and 13, the bore 93 preferably extends along substantially the entire longitudinal length of the engagement portion 67 of the clamp 42. With reference to FIG. 13, the bore 93 is defined by an interior surface 95 of the clamp 42. The configuration of this interior surface 95 is such that the bore 93 is adapted to rotatably carry the lifting shaft 75. Most preferably, this interior surface 95 is shaped so as to define a semi-circle in cross-section, thereby allowing an appropriately dimensioned cylindrical lifting shaft 75 to be rotatably received in the bore 93. Preferably, the arcuate extent of the interior bore surface 95 is greater than 180°, so that the interior bore surface 95 will embrace more than half of the circumferential extent of an appropriately dimensioned lifting shaft 75, thus ensuring the lifting shaft 75 is maintained within the bore 93.

In preferred embodiments of the invention, the engagement portion 67 of the clamp 42 defines an opening communicating with the bore 93. With reference to FIG. 13, it can be seen that the bore 93 opens through a wall of the clamp 42. Specifically, the bore 93 opens through the wall that defines the contact surface 96. Thus, when the clamp 42 is mounted to the holder body 12, the opening of the bore 93 is oriented generally toward the support plate 14. This opening can also be characterized as a longitudinally-extending slot that communicates with the bore 93. With continued reference to FIG. 13, the slot is bounded on one side by an exterior corner formed by the intersection of the interior bore surface 95 and the contact surface 96 of the clamp 42. On its other side, the slot is bounded by a lip-like structure 97 between the interior bore surface 95 and the upwardly and sidewardly sloped surface 91 of the clamp 42.

As noted above, the bore 93 is configured to rotatably carry the elongated lifting shaft 75. The relative dimensions of the bore 93 and the shaft 75 are selected such that the shaft 75 is allowed to rotate about its central axis within the bore 93, yet is prevented from escaping through the opening (or slot) of the bore 93. Thus, when the shaft 75 and the bore 93 are both circular in cross-section, the shaft 75 preferably has an outer diameter that is less than the inner diameter of the bore 93, but greater than the width of the bore opening. Preferably, the outer dimension of the shaft 75 is slightly less than, and perhaps optimally substantially the same as, the inner dimension of the bore 93. For example, when the lifting shaft 75 is cylindrical, the shaft 75 and the bore 93 are preferably dimensioned such that the inner surface 95 of the bore 93 is slidingly contiguous with the side 77 of the shaft 75.

Figure 9:
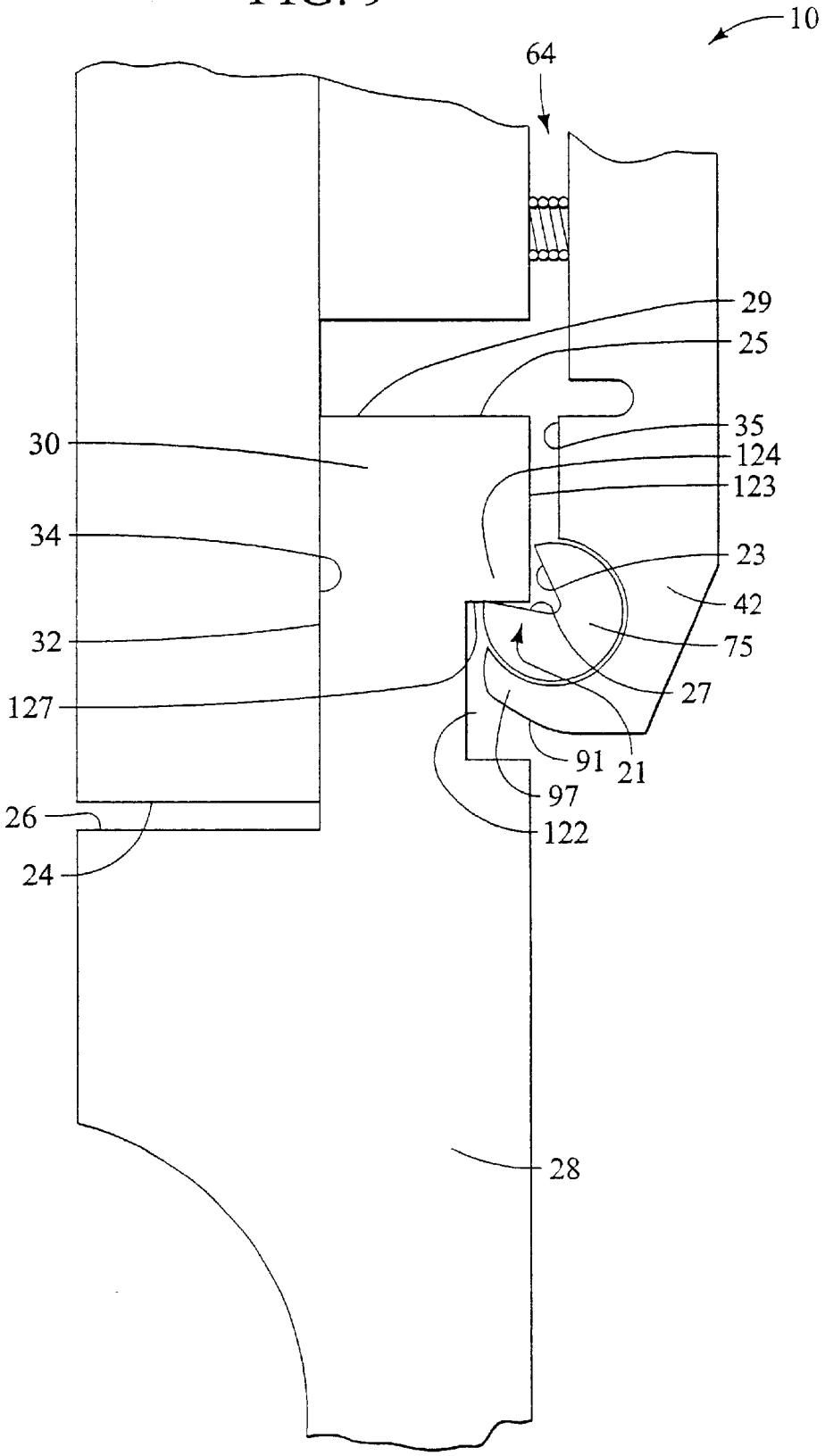
FIG. 9 is a close-up end view of the unclamped tool holder of FIG. 8.
Figure 11:
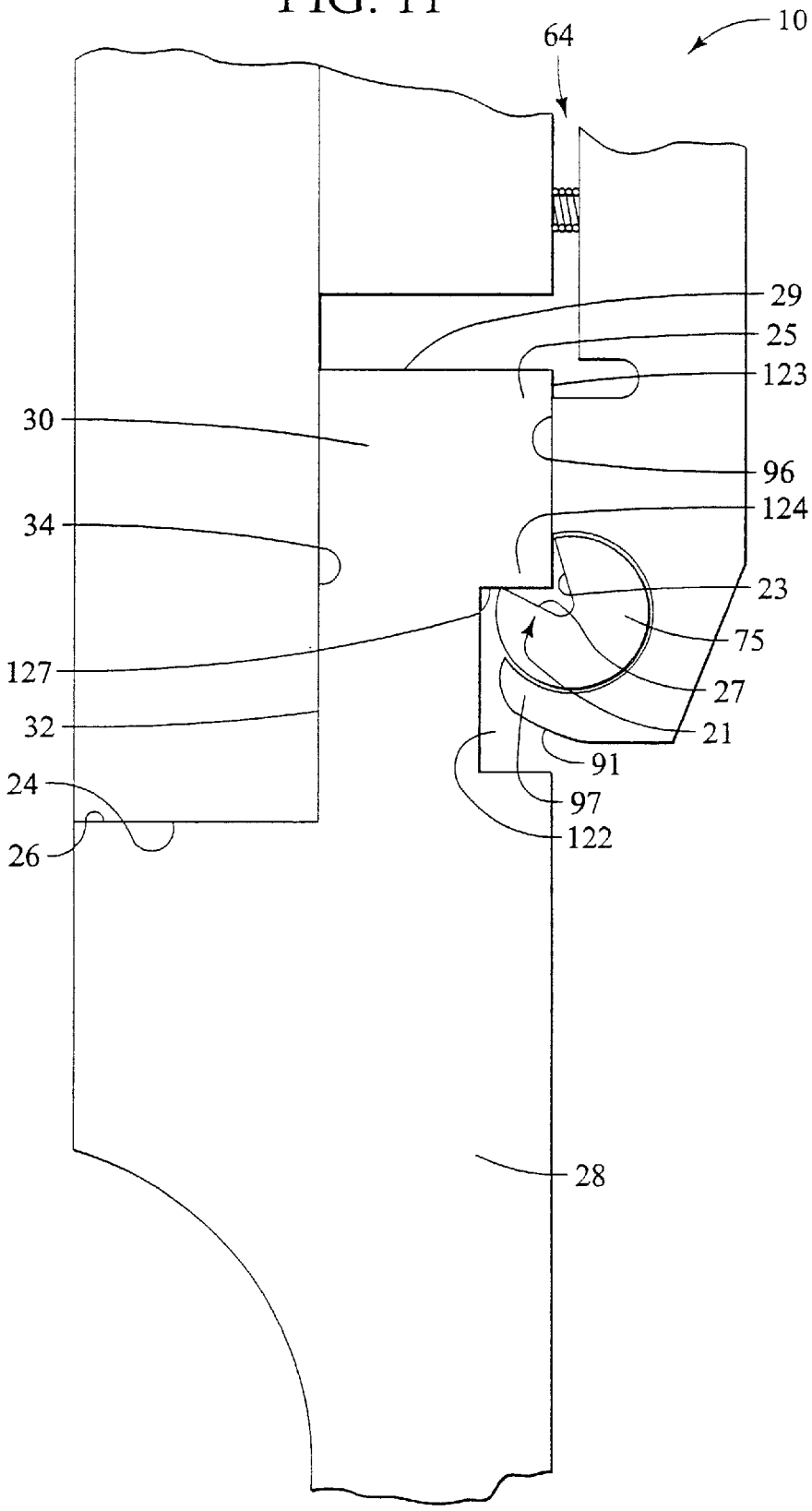
FIG. 11 is a close-up end view of the clamped tool holder of FIG. 10.

As is perhaps best understood with reference to FIGS. 9 and 11, the lifting shaft 75 has therein formed a notch 21 that is adapted to be engaged through the opening of the bore by an exterior corner of a forming tool. The exterior corner (i.e., the exterior tool corner) is defined by first 123 and second 127 corner surfaces. The notch is advantageously configured such that when the engagement portion of the clamp is forced against such tool, the first corner surface 123 bears against a first surface portion 23 of the notch 21 and causes the shaft 75 to rotate about its axis within the bore 93, thereby bringing a second surface portion 27 of the notch 21 to bear against the second corner surface 127. Thus, a mounting force having a component normal to the second corner surface 127 is delivered to the tool 28.

Figure 12:
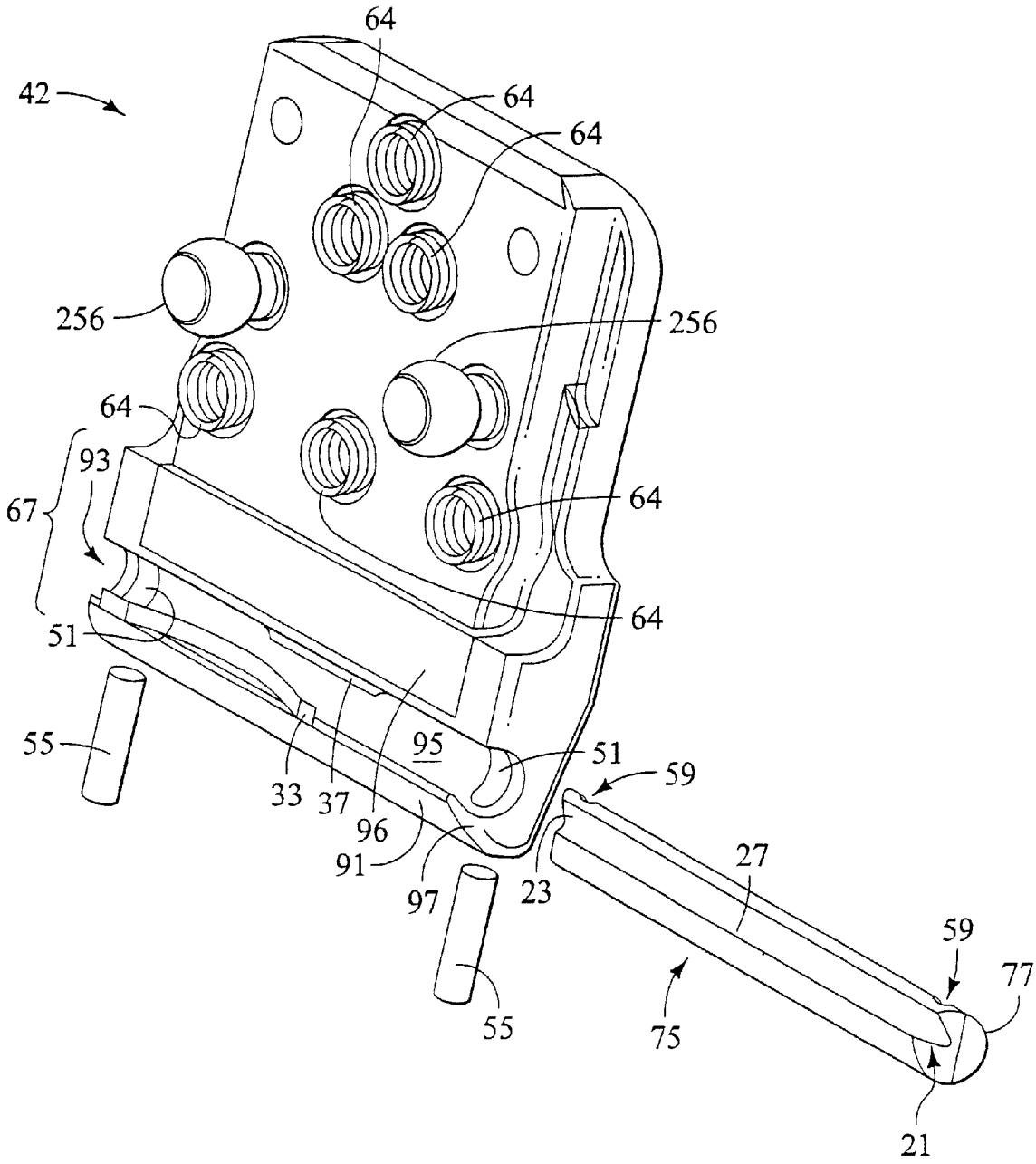
FIG. 12 is an exploded perspective view of a tool holder clamp in accordance with a preferred embodiment of the invention.
Figure 13:
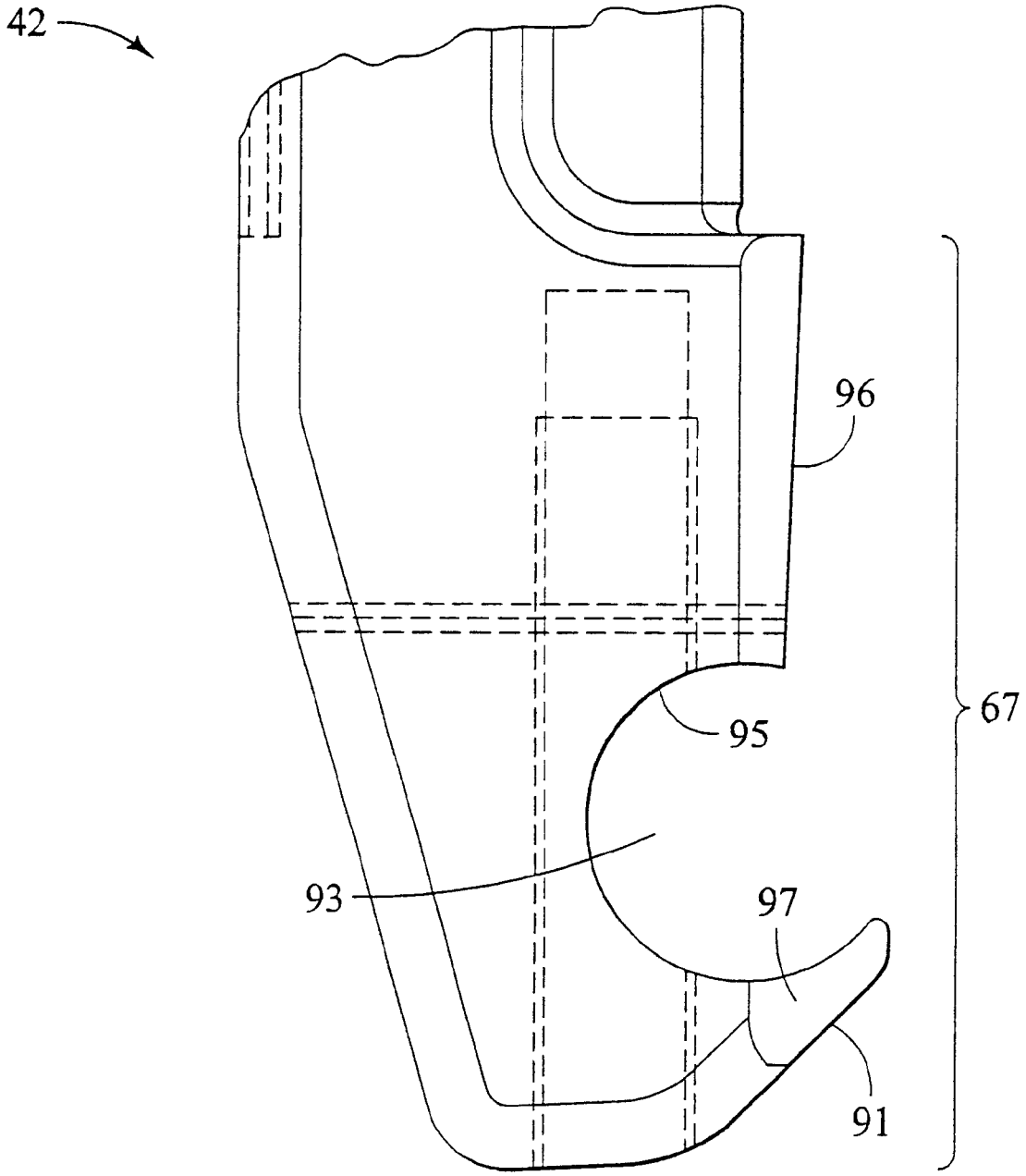
FIG. 13 is an end view of the engagement portion of the tool holder clamp of FIG. 12.

As is best seen in FIG. 12, the notch 21 preferably extends along the entire longitudinal length of the lifting shaft 75. With reference to FIG. 14B, the notch 21 spans an angle 29 of less than 900, as measured from the central axis (or "longitudinal axis") of the shaft 75. While any acute notch angle 29 will enable the lifting function of the shaft 75, a notch angle of less than about 75°, perhaps optimally equal to about 60°, will enhance the lifting operation of the shaft 75. Moreover, a notch angle 29 of at least about 45° will facilitate engaging the notch 21 with an exterior corner of a forming tool, as discussed below.

Figure 16A:
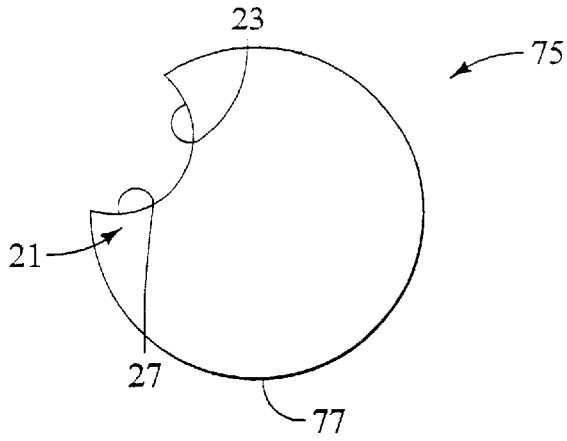
FIG. 16A is an end view of a lifting shaft in accordance with yet another embodiment of the invention.
Figure 16B:
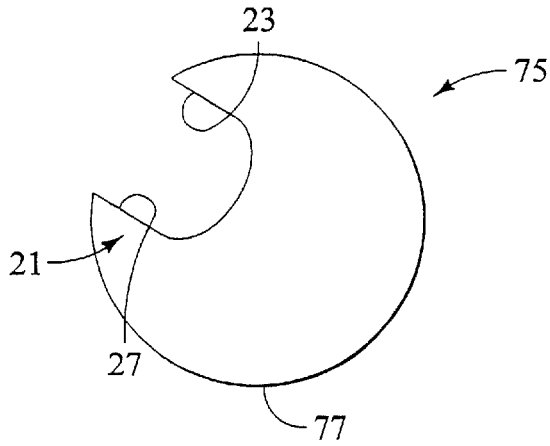
FIG. 16B is an end view of a lifting shaft in accordance with still another embodiment of the invention.
Figure 16C:
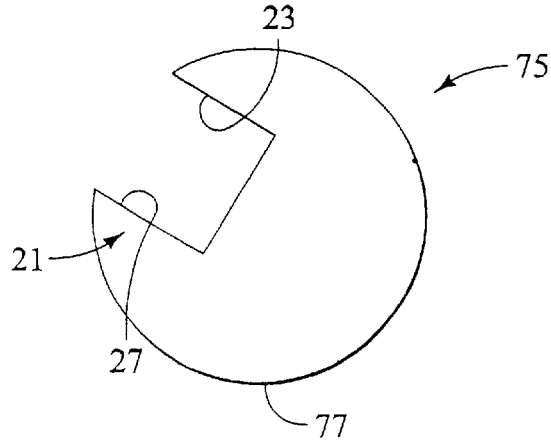
FIG. 16C is an end view of a lifting shaft in accordance with yet another embodiment of the invention.

In cross-section, the notch 21 preferably has a generally "V"-shaped configuration. However, this is certainly not a requirement, as many other notch configurations would be useful as well. For example, the notch 21 can alternatively have a semi-circular cross-sectional configuration (as shown in FIG. 16A). In another embodiment, the notch 21 is "U"-shaped in cross-section (as shown in FIG. 16B). Still another embodiment involves a notch 21 with a generally square cross-sectional configuration (as shown in FIG. 16C). A variety of other suitable notch configurations would be obvious to those skilled in the present art.

Figure 14B:
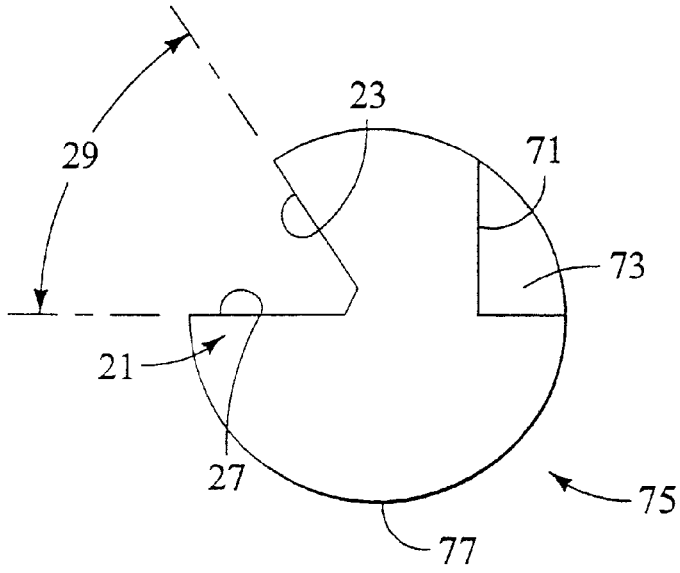
FIG. 14B is a cross-sectional view of the lifting shaft of FIG. 14A, taken along line 14B—14B of FIG. 14A.
Figure 15A:
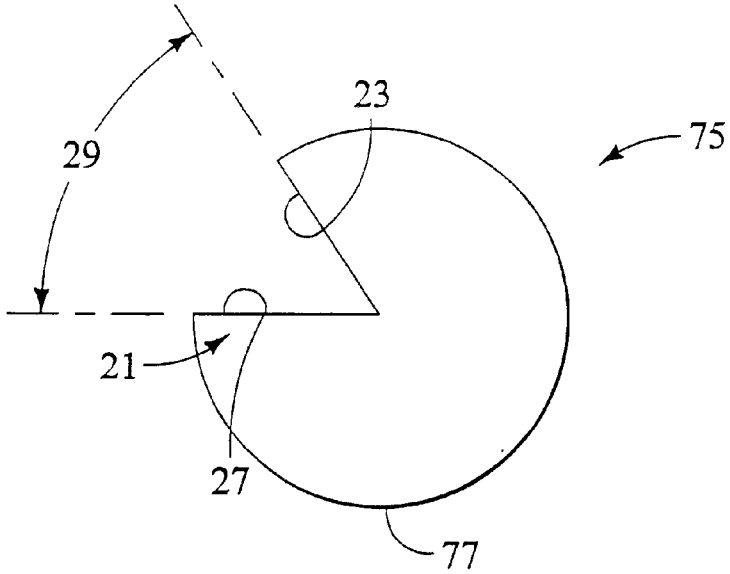
FIG. 15A is an end view of a lifting shaft in accordance with another embodiment of the invention.
Figure 15B:
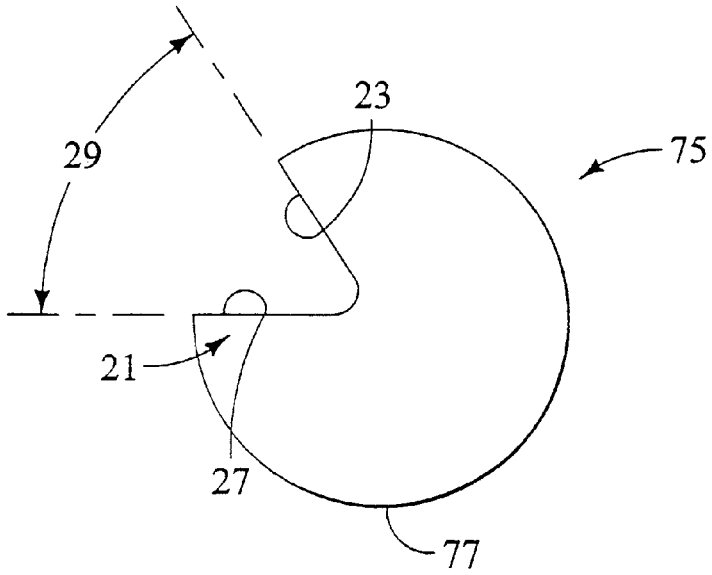
FIG. 15B is an end view of a lifting shaft in accordance with still another embodiment of the invention.

The notch 21 is defined by at least one notch surface. FIGS. 15B and 16A illustrate embodiments wherein the notch 21 is defined by a single surface. Alternatively, the notch 21 can be defined by two surfaces, as illustrated in FIGS. 15A. FIGS. 14B, 16B, and 16C illustrate embodiments wherein the notch 21 is defined by three surfaces. Regardless of the particular number of notch surfaces, the notch 21 includes first 23 and second 27 surface portions that are adapted to engage an exterior corner of a forming tool, as discussed below.

FIG. 12 illustrates a particularly preferred manner of incorporating the lifting shaft 75 into a clamp 42 of the invention. It is advantageous to limit the rotational freedom of the lifting shaft 75 within the bore 93. Specifically, it is desirable to secure the lifting shaft 75 within the bore 93 in such a way that the shaft 75 is prevented from rotating into an orientation wherein the notch 21 is concealed entirely by the inner bore surface 95. In other words, it is desirable to limit the shaft 75 to a range of rotation in which, at all possible shaft 75 orientations, at least a portion of the notch 21 is exposed through the bore opening (or slot). Optimally, the shaft 75 is limited to a range of rotation in which the entire notch 21 is exposed through the bore opening at all possible orientations.

With reference to FIG. 12, it can be seen that the rotational freedom of the lifting shaft 75 can be limited by one or more set pins 55. The illustrated clamp 42 embodiment employs two set pins 55 secured within transverse bores 51 opening through the surface 95 of the longitudinal bore 93. When the pins 55 are seated respectively in the transverse bores 51, a portion of each pin 55 projects diametrically from the transverse bore 55 and beyond the surface 95 of the longitudinal bore 93. This projection of each set pin 55 is adapted to engage a transverse groove 59 formed in the lifting shaft 75. Thus, when the lifting shaft 75 is within the longitudinal bore 93, the set pins 55 are received in the respective transverse grooves 59 in the lifting shaft 75. Rotation of the shaft 75 far enough in either direction (i.e., clockwise or counterclockwise) brings the set pins 55 into contact with the transverse groove surfaces, thus limiting rotational of the shaft 75. It is also noted that the set pins 55 prevent the shaft 75 from sliding longitudinally out of the bore 93.

In particularly preferred embodiments, the lifting shaft 75 is urged into a desired default orientation when the clamp 42 is not engaged with a forming tool. With reference to FIG. 4, the lifting shaft 75 of the clamp 42 is depicted in a default orientation that is favorable for initiating clamping action of the tool holder 10. In this orientation, the notch 21 is readily engagable with the exterior corner 124 (or shoulder) above the safety slot 122 of a conventional forming tool (not shown). In further detail, the second surface portion 27 of the thus oriented notch 21 is generally horizontal. Thus, when a tool 28 is lifted into the unclamped position depicted in FIG. 9 and then released, the second surface portion 27 of the notch 21 is adapted to catch (i.e., engage) the downward-facing surface 127 of the shoulder 124 above the safety slot 122.

With reference to FIG. 12, it can be seen that a spring can be used to retain the lifting shaft in a desired orientation when the clamp is not engaged with a tool. In the illustrated embodiment, a leaf spring 33 is positioned between the lifting shaft 75 and the inner surface 95 of the longitudinal bore 93. In further detail, the leaf spring 33 is an elongated body of resilient material (e.g., metal or plastic) that assumes an arcuate (i.e., curvedly bent) configuration when uncompressed. The leaf spring 33 is sufficiently thin to be positioned between the shaft 75 and the inner surface 95 of the bore 93. A central portion of the leaf spring 33 is positioned in a notch 37 formed in the interior surface 95 of the longitudinal bore 93. While the spring 33 can be secured in this notch 37 by means of soldering, adhesives, or the like, this is not believed to be necessary as the spring 33 will effectively be trapped in the notch 37 when the lifting shaft 75 is within the bore 93.

Figure 14A:
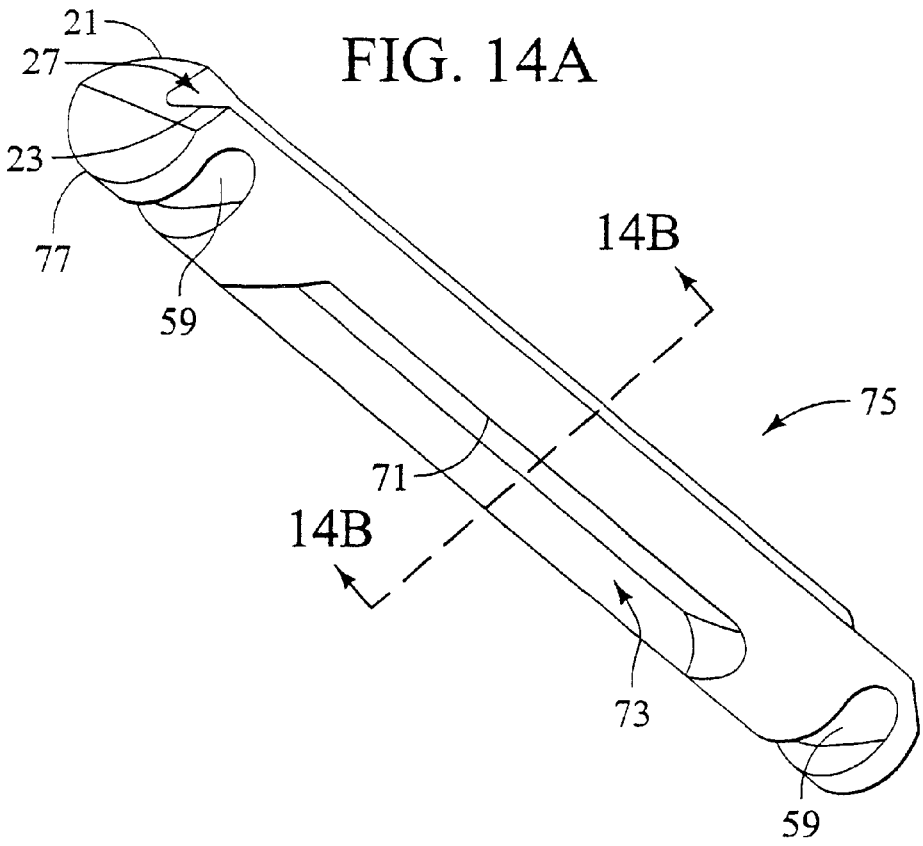
FIG. 14A is a perspective view of the lifting shaft of the tool holder clamp of FIG. 12.

With reference to FIG. 14A, it is seen that a groove 73 can be formed in the side 77 of the lifting shaft 75 to facilitate use of the leaf spring 33. The groove 73 is configured to receive the leaf spring 33 when the shaft 75 and spring 33 are both within the bore 93. Preferably, the groove 73 is long enough to receive the entire length of the leaf spring 33 when the spring 33 is fully compressed. The compressed spring 33 bears against a surface 71 of the groove 73, thereby delivering a spring force to the lifting shaft 75. This force urges rotation of the lifting shaft 75 toward the desired default orientation. With reference to FIG. 4, the ends of the spring 33 bear against the groove surface 71 in the lifting shaft 75, thereby urging rotation of the shaft 75 in the counterclockwise direction (as seen in FIG. 4). The lifting shaft 75 is prevented from rotating too far (i.e., past the default orientation) by the rotational limits defined by the pins 55. Thus, rotation of the lifting shaft 75 in the counterclockwise direction (as seen in FIG. 4) is stopped when the pins 55 are engaged by the surfaces of the transverse grooves 59 in the shaft 75. It is noted that the ends of the leaf spring 33 are preferably flattened (i.e., not arcuate) to provide better contact with the surface 71 of the groove 73.

The lifting action of the shaft 75 is best understood with reference to FIGS. 8–11, which depict operation of a particularly preferred tool holder of the invention. With reference to FIG. 8, the tool holder 10 is depicted in an unclamped position about a forming tool 28. The mounting tang 30 of the tool 28 is positioned between the support plate 14 and the engagement portion 67 of the clamp 42. In further detail, a first side of the tool 28 includes a first mounting surface 32 that is engaged with the first receiving surface 34 of the support plate 14. A second side of the tool 28 includes a safety slot 122 above which is formed an exterior corner 124 (or shoulder) that is adapted to engage the notch 21 in the lifting shaft 75. The illustrated tool 28 also includes a load-bearing mounting surface 26 that forms an included right angle with the first mounting surface 32. The load-bearing surface 26 of the tool 28 is adapted to engage the load-bearing surface 24 of the support plate 14. However, the tool holder 10 of FIG. 8 is depicted in its unclamped position, wherein the load-bearing surfaces of the tool and the support plate are not engaged.

As is perhaps best understood with reference to FIG. 9, the tool holder 10 prevents the tool 28 from falling from the holder 10, even when the holder is in its unclamped position. The clamp 42 preferably has an inwardly-turned lip 97 at its lower end. As noted above, this lip 97 embraces a sufficient circumferential extent of the lifting shaft 75 to prevent the shaft 75 from escaping through the opening (or slot) of the bore 93. With continued reference to FIG. 9, it can be seen that the lifting shaft 75 projects somewhat from the bore opening. In further detail, the notched portion of the shaft 75 projects generally inwardly (i.e., toward the support plate) beyond the contact surface 96 of the clamp 42.

When a forming tool 28 is lifted into the position depicted in FIG. 9, the mounting tang 30 of the tool 28 engages the upwardly and inwardly sloped surface 91 of the lip 97, thereby urging the lower portion 68 of the clamp 42 away from the support plate 14. This causes the clamp 42 to pivot about its attachment to the holder body 12 in a counterclockwise direction (as seen in FIG. 9) until there is provided enough clearance for the mounting tang 30 of the tool 28 to pass between the clamp 42 and the support plate 14.

As the mounting tang 30 of the tool 28 is moved far enough upward to bring the downward and sideward facing shoulder 124 of the tool 28 into alignment with the notch 21, the lower end 68 of the clamp 42 is urged back toward the support plate 14 by the springs 64 (in cooperation with the mounting pins and slots). This brings the notch 21 into engagement with the shoulder 124 of the tool 28. Thereafter, when the tool 28 is released and urged downward under its own weight, the downward-facing surface 127 of the safety slot 122 bears against the second surface portion 27 of the notch 21.

It is noted that when the tool holder 10 is in its unclamped position about a tool 28, the springs 64 advantageously cooperate with the mounting pins 54 and slots to resiliently maintain engagement of the clamp 42 and the tool 28. In further detail, the clamp 42 is advantageously maintained in a position wherein the spacing between the first receiving surface 34 of the support plate 14 and the lip 97 of the clamp 42 is slightly less than the width of the tool shank 30. Thus, the lip 97 and part of the second surface portion 27 of the notch 21 are at least loosely seated in the safety slot 122, thereby preventing the forming tool 28 from falling from the tool holder even when the clamp 42 is in its unlocked (i.e., unclamped) position.

As noted above, the lifting shaft 75 is desirably restrained to a limited range of rotation such that the second surface portion 27 of the notch 21 is not allowed to rotate beyond the lip 97 of the clamp 42. When the tool holder 10 is in its unclamped position about a forming tool 28 (as depicted in FIG. 9), the weight of the tool 28 acting upon the second surface portion 27 of the notch 21 preferably does not cause the shaft 75 to rotate so far as to bring the downward-facing safety slot surface 127 into contact with the lip 97 of the clamp 42. Of course, this is not a requirement, as the lifting shaft 75 would not rotate much beyond this point even in cases where the shaft 75 has an unlimited range of rotation. In such cases, the lip 97 of the clamp 42 would eventually catch the downward-facing safety slot surface 127, thereby preventing further downward movement of the tool, hence limiting counterclockwise rotation of the shaft. Limiting the rotation of the lifting shaft 75 is beneficial, though, as it facilitates establishing a default notch orientation, as discussed above.

The clamping action of the tool holder is perhaps best understood with reference to FIGS. 8–11. With reference to FIG. 8, the engagement portion 67 of the clamp 42 can be forced against the tool 28 by causing the clamp 42 to pivot. In the embodiment of FIG. 8, the clamp 42 is made to pivot by rotating the cam shaft 74 so as to bring its major axis toward approximate alignment with the cam follower pins 102,104. This is accomplished by moving the handle 82 (manually or otherwise) upward from the position shown in FIG. 8 to the position shown in FIG. 10. The cam shaft 74 thus drives the pins 102, 104 outwardly against the upper portions 66 of the clamps 40, 42, thereby causing the lower portions 68 of the clamps to pivot toward the support plate 14. As the lower portion 68 of the first clamp 42 closes upon the shank 30 of the forming tool 28, the tool is clamped securely to the holder. It is noted that each clamp 40, 42 moves independently of the other in this embodiment. Thus, if the second clamp 40 were removed, for example, the first clamp 42 would still operate as described.

As noted above, any desired actuator mechanism can be used as an alternative to the rotating cam shaft 74 described above. For example, an over-the-center plunger-type actuator can alternatively be used to cause a clamp of the invention to pivot. Useful plunger actuators are disclosed in U.S. Pat. No. 6,138,492, the teachings of which are incorporated herein by reference. Here, the plunger actuator is linked to the upper end of an actuator arm that is pivotally attached to a tool holder plate. By extending the plunger actuator, the upper end of the arm is driven away from the holder plate, thereby causing the arm to pivot, and conjointly moving the lower end of the arm toward the holder plate. In much the same manner, a plunger actuator can be linked to the upper portion 66 of a clamp in accordance with the present invention. Those skilled in the art will appreciate that many other mechanical, pneumatic, hydraulic, or electrical actuators can be used as well.

As discussed above, the engagement portion 67 of the clamp 42 can be forced against the tool 28 by causing the clamp 42 to pivot. As is perhaps best understood with reference to FIG. 9, this causes the vertical surface 123 (i.e., the first surface of the exterior tool corner) above the safety slot 122 on the tool 28 to bear against the first surface portion 23 of the notch 21 when the clamp 42 is forced against the tool 28. This in turn causes the lifting shaft 75 to rotate about its axis within the bore 93 (in the clockwise direction as seen in FIG. 9), thereby bringing the second surface portion 27 of the notch 21 to bear against the downward-facing surface 127 (i.e., the second surface of the exterior tool corner) of the tool 28. In this manner, the lifting shaft 75 delivers to the tool 28 a mounting force having a component normal to the downward-facing surface 127 of the tool 28. In the embodiment illustrated in FIG. 9, this is an upward component that urges the tool 28 to move in an upward direction. Thus, delivery of mounting force to the tool 28 urges the load-bearing surface 26 of the tool 28 toward the load-bearing surface 24 of the support plate 14.

Figure 10:
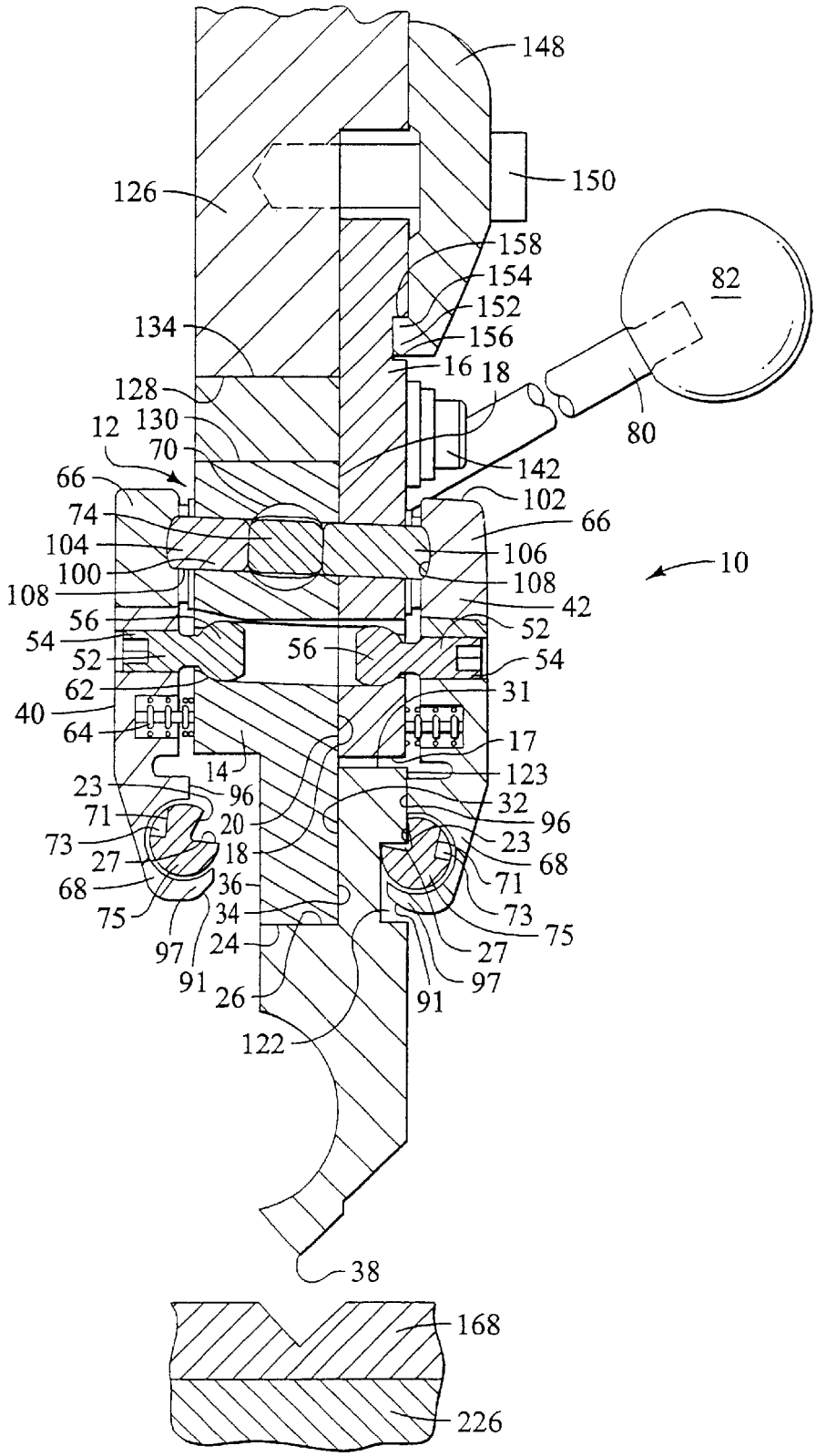
FIG. 10 is a cross-sectional end view of the tool holder of FIG. 8 in which the tool holder is depicted mounted to the beam of a press brake and clamped about the forming tool.

The lifting action of the shaft 75 desirably causes enough upward movement of the tool 28 to bring the load-bearing surfaces of the tool and the support plate into engagement. In further detail, the tolerances of the tool holder 10 are preferably such that the load-bearing mounting surface 26 of the tool comes into contact with the load-bearing receiving surface 24 of the support plate 14 just as the contact surface 96 of the clamp 42 engages the confronting surface 123 of the tool 28. This assures that the tool 28 is securely clamped to the holder and restrained against unintentional movement in both the vertical and horizontal directions. Thus, the forming tool 28 can be secured in an operative position as an adjunct of the clamping action of the tool holder 10. Accordingly, it is not necessary to force the tip 38 (e.g., the workpiece—deforming surface) of the tool 28 against a forming die 168 on a lower press brake table 226 (as seen in FIG. 10) to bring the load-bearing surfaces of the tool and the support plate together (i.e., into engagement with one another).

It is noted that the handle 80 of the tool holder 10 is desirably removably secured in the bore 88, as is best seen in FIG. 7. Thus, when the forming tool 28 is in the operative position depicted in FIGS. 10 and 11, the handle 80 can be removed from the tool holder 10 by simply pulling the handle 80 upwardly and away from the holder 10. On the other hand, when the operator desires to remove the tool 28 from the tool holder 10, the handle 80 is reattached to the holder 10 by inserting the shaft 86 back into the bore 88. The operator can then move the handle 80 from the position depicted in FIG. 10 downwardly to the position depicted in FIG. 8, the relay releasing the clamping pressure of the clamp 42 on the tool 28. Once the handle has been thus moved to the unclamped position, the presence of the lip 116 and part of shaft 75 in the safety slot 122 prevents the tool 28 from falling from the holder. As noted above, the tool 28 is retained somewhat loosely between the clamp 42 and the support plate 14, even in the unclamped position illustrated in FIGS. 8 and 9.

Figure 17:
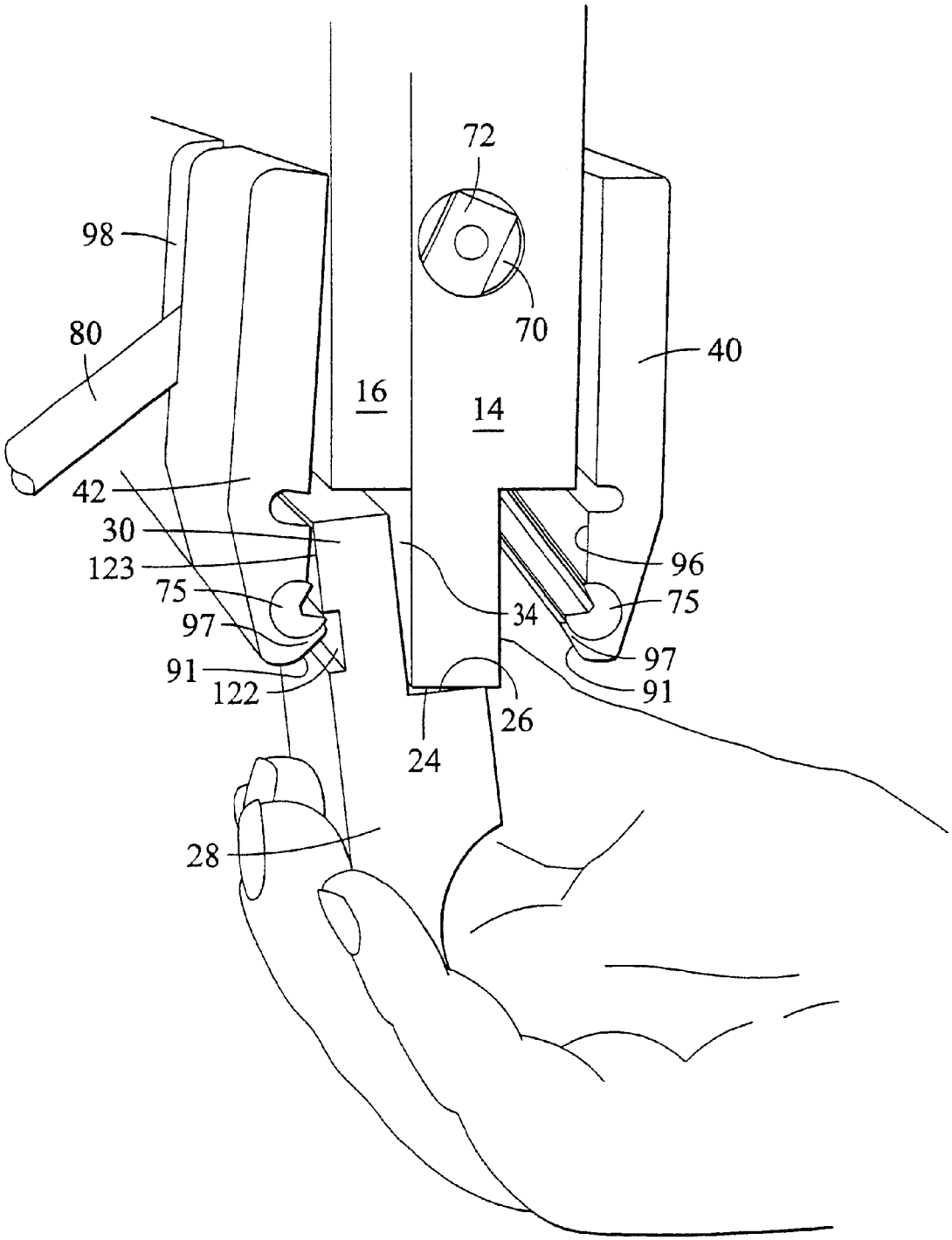
FIG. 17 is a perspective, broken-away schematic view of the tool holder of FIG. 6 in which is depicted removal of tooling from the holder.

At this point, the tool 28 can be horizontally slid from the tool holder 10 unless there is other structure in the way. Preferably, the tool is removed from the holder by manually grasping the tool as shown in FIG. 17 and pulling the lower end of the tool away from the clamp 42. This movement causes the tool shank 30 to pivot about the bottom edge of the support plate 14, the upper edge of the tool shank 30 pressing outwardly upon the clamp, which in turn resiliently pivots outwardly to enable the lip 116 and lifting shaft 75 to fully escape the safety slot 122. The operator advantageously uses both hands to perform this task, so as to reduce the chances of accidentally dropping the tool 28.

The various manners in which a tool holder of the invention can be mounted to the beam of an upper press brake table would be apparent to those skilled in the art. FIG. 10 depicts a preferred manner of mounting the tool holder 10 to an upper press brake table. The press brake assembly of FIG. 10 includes an upper press brake table including the body 12 of the tool holder 10, and a lower press brake table 226 including a forming die 168. Shown in cross-section is the longitudinally-extending beam 126 of an upper press brake table. Between the bottom shoulder 128 of the press brake beam 126, which extends longitudinally, is positioned a wedge 132 having upwardly and downward facing surfaces 134,136, respectfully. The latter surfaces encounter the respective shoulders 128,130. As shown best in FIG. 7, the wedge 132 tapers in height from one end 138 to the other 140, the taper of the wedge compensating precisely for the non-horizontal surface 130 of the support plate 14 such that the bottom surface 24 of the support plate is horizontal and parallel to the upper surface 134 of the wedge 132. Thus, the distance between the tool's bottom edge 38 (i.e., the workpiece-deforming surface oriented downwardly toward the forming die 168) and the shoulder 128 of the press brake beam 126 can be adjusted by moving the wedge to the left or right (as seen in FIG. 7). Once the exact height of the tool edge 38 has been attained, the wedge 132 is locked in place by means of threaded bolts 142 passing through longitudinally-elongated slots 144 formed in the mount plate 16 and thence into threaded holes 196 in the wedge 132. In this manner, the mount plate 16 and the wedge 132 are held securely together. When the threaded bolts 142 are loosened, the wedge 132 together with the bolts 142 can be moved to the left or right (as seen in FIG. 7) to achieve the desired vertical positioning of the tool edge 38.

The mounting plate 16 can be mounted to the beam 126 of the upper press brake table by means of a generally "C"-shaped clamp 148. This clamp 148 preferably extends longitudinally along substantially the entire length of the tool holder 10. The clamp 148 is joined to the beam 126 by means of a threaded screw 150 that passes through the clamp 148 and into the beam 126. At its lower edge, the clamp 148 includes an inwardly-turned lip 152 having an upwardly-facing shoulder 154. The lip 152 is received within a longitudinally-extending slot 156 in the outer surface of the mount plate 16. The slot 156 has a downward-facing shoulder 158 that confronts the shoulder 154 when the tool holder 10 is mounted to the upper table of a press brake.

The tool holder 10 can be readily removed from the beam 126 of a press brake by simply unscrewing the bolts 150. With reference to FIG. 11, it is noted that as the bolts 150 are unscrewed from the beam 126 of the press brake, the clamp 148 is loosened. However, the upward-facing shoulder 154 of the lip 152 remains in contact with the downward-acing shoulder 158 of the slot formed in the mount plate 16 and tends to prevent the tool holder 10 from being dropped unintentionally from the clamp 148. Once the bolts 150 have been appropriately loosened, the tool holder 10 can be manually grasped, and the lip 152 of the clamp 148 can be removed from the slot 156, thereby allowing the tool holder 10 to be safety lowered from the beam 126 of the press brake. It is lastly noted that each edge, transition region, interior corner, and the like of the present tool holder is preferably provided with a radius to provide stress relief, as is conventional in the present art.

While preferred embodiments of the present invention have been described, it should be understood that a variety of changes, adaptations, and modifications can be made therein without departing from the spirit of the invention and the scope of the appended claims.

What is claimed is:

1. A tool holder apparatus for a press brake, the apparatus comprising a support plate having a first receiving surface, and a pivotable clamp having an engagement portion that is moveable toward said first receiving surface by pivoting the clamp, the engagement portion having therein formed a bore in which a lifting shaft is rotatably received, the engagement portion defining an opening communicating with the bore, the shaft having therein formed a notch that is adapted to be engaged through said opening by an exterior corner of a forming tool, the notch being configured such that when the engagement portion of the clamp is forced against such tool a first surface of said exterior corner bears against a first surface portion of the notch and causes the shaft to rotate within the bore, thereby bringing a second surface portion of the notch to bear against a second surface of said exterior corner and delivering to the tool a mounting force having a component normal to the second surface of said exterior corner.

2. The apparatus of claim 1 wherein the support plate further includes a load-bearing receiving surface forming an exterior corner together with said first receiving surface, the delivery of said mounting force urging a load-bearing mounting surface of the tool toward the load-bearing surface of the support plate.

3. The apparatus of claim 2 wherein the load-bearing surface of the support plate is a generally horizontal surface.

4. The apparatus of claim 3 wherein the first receiving surface of the support plate is a generally vertical surface.

5. The apparatus of claim 3 wherein the load-bearing surface of the support plate is a generally-downward facing surface.

6. The apparatus of claim 1 wherein the notch is defined by a single notch surface comprising both said first and second notch surface portions.

7. The apparatus of claim 1 wherein the notch is bounded by first and second notch surfaces, the first notch surface comprising said first notch surface portion, the second notch surface comprising said second notch surface portion.

8. The apparatus of claim 7 wherein the first and second notch surfaces are separated by an acute notch angle.

9. The apparatus of claim 8 wherein said notch angle is between about 45 degrees and about 75 degrees.

10. The apparatus of claim 9 wherein said notch angle is about 60 degrees.

11. The apparatus of claim 7 wherein the notch further includes a third notch surface joining the first and second notch surfaces.

12. The apparatus of claim 1 wherein the lifting shaft is restrained to a limited range of rotation in which at least a portion of the notch is exposed through said opening at all possible orientations of the shaft.

13. The apparatus of claim 12 wherein the entire notch is exposed at all possible orientations of the shaft.

14. The apparatus of claim 12 wherein the lifting shaft is urged by a spring seated in said bore toward a desired default orientation in which the entire notch is exposed through said opening.

15. The apparatus of claim 1 wherein the support plate forms part of a tool holder body to which the clamp is pivotally attached.

16. The apparatus of claim 15 wherein the clamp has an upper portion and a lower portion and is attached therebetween to the tool holder body.

17. The apparatus of claim 16 wherein the lower portion of the clamp comprises said engagement portion.

18. The apparatus of claim 16 wherein the clamp is attached to the tool holder body by a plurality of pins each extending from one of the clamp and the body and terminating in an enlarged head received in a recess defined by the other of the clamp and the body, the enlarged heads and respective recesses being shaped to articulate together when the clamp is made to pivot.

19. The apparatus of claim 18 wherein the enlarged heads of the pins are aligned to define an axis about which the clamp is pivoted.

20. A tool holder assembly for a press brake, the assembly comprising:

a) a support plate having a first receiving surface and a load-bearing receiving surface;

b) a forming tool having a first mounting surface on a first side thereof and an exterior corner on a second side thereof, said first mounting surface being engaged with the first receiving surface of the support plate, the tool having a load-bearing mounting surface forming an included right angle with said first mounting surface, said load-bearing mounting surface being adapted to engage the load-bearing surface of the support plate; and c) a pivotable clamp having an engagement portion that is moveable toward said first receiving surface by pivoting the clamp, the engagement portion having therein formed a bore in which a lifting shaft is rotatably received, the engagement portion defining an opening communicating with the bore, the shaft having therein formed a notch that is adapted to be engaged through said opening by said exterior corner of the forming tool, the notch being configured such that when the engagement portion of the clamp is forced against said tool a first surface of said exterior corner bears against a first surface portion of the notch and causes the shaft to rotate within the bore, thereby bringing a second surface portion of the notch to bear against a second surface of said exterior corner and delivering to the tool a mounting force having a component normal to the second surface of said exterior corner.

21. The assembly of claim 20 wherein said receiving surfaces of the support plate together define an exterior corner, the delivery of said mounting force urging the load-bearing surface of the tool toward the load-bearing surface of the support plate.

22. The assembly of claim 20 wherein the load-bearing surface of the support plate is a generally-horizontal, downward-facing surface.

23. The assembly of claim 22 wherein the load-bearing surface of the tool is a generally-horizontal, upward-facing surface.

24. The assembly of claim 23 wherein said second surface of the exterior corner of the tool is a generally-horizontal, downward-facing surface.

25. The assembly of claim 24 wherein the first receiving surface of the support plate and said first surface of the exterior corner of the tool are both generally-vertical surfaces.

26. An upper press brake assembly comprising:

a) an upper press brake table including a tool holder body;

b) a support plate forming part of the tool holder body and having a first receiving surface and a generally downward-facing load-bearing receiving surface, said receiving surfaces together defining an exterior corner;

c) a forming tool having a first mounting surface on a first side thereof and an exterior corner defined by first and second corner surfaces on a second side thereof, said second corner surface being generally-downwardly-facing, the first mounting surface of the tool being engaged with the first receiving surface of the support plate, the tool having a load-bearing mounting surface forming an included angle with said first mounting surface and being adapted to engage the generally downward-facing load-bearing receiving surface of the support plate; and d) a clamp attached pivotally to the tool holder body and having an engagement portion that is moveable toward said first receiving surface by pivoting the clamp, said engagement portion having therein formed a bore in which a lifting shaft is rotatably received, the engagement portion defining an opening communicating with the bore, the shaft having therein formed a notch that is adapted to be engaged through said opening by said exterior corner of the tool, the notch being configured such that when the engagement portion of the clamp is forced against the tool said first corner surface bears against a first surface portion of the notch and causes the shaft to rotate within the bore, thereby bringing a second surface portion of the notch to bear against said second corner surface and delivering to the tool a mounting force having a generally-upward component.

27. A tool holder apparatus for a press brake, the apparatus comprising:

a) a support plate having a first receiving surface and a generally downward-facing receiving surface, said receiving surfaces together defining an exterior corner; and b) a pivotable clamp having an engagement portion that is moveable toward said first receiving surface by pivoting the clamp, the engagement portion having therein formed a bore in which a lifting shaft is rotatably carried, the engagement portion defining a slot communicating with the bore, the shaft having therein formed a notch that is adapted to be engaged through said slot by an exterior corner of a forming tool a mounting tang of which is positioned between the first receiving surface of the support plate and the engagement portion of the clamp, the notch being configured such that when the engagement portion of the clamp is forced against such tool a generally-vertical surface of said exterior corner bears against a first surface portion of the notch and causes the shaft to rotate within the bore, thereby bringing a second surface portion of the notch to bear against a generally-downward-facing surface of said exterior corner and delivering to the tool a mounting force having a generally-upward component.

28. A tool holder apparatus for a press brake, the apparatus comprising a support plate having a first receiving surface, and a clamp having an engagement portion defining a slot communicating with a bore formed therein in which a lifting shaft is rotatably received, the shaft having therein formed a notch that can be engaged through said slot by an exterior corner of a forming tool, the notch being configured such that when it is forced against said exterior corner a first surface of said exterior corner bears against a first surface portion of the notch and causes the shaft to rotate within the bore, thereby bringing a second surface portion of the notch to bear against a second surface of said exterior corner and delivering to the tool a mounting force having a component normal to the second surface of said exterior corner.

29. A press brake assembly comprising:

a) an upper press brake table including a tool holder body;

b) a lower press brake table including a forming die;

c) a support plate forming part of said tool holder body and having a first receiving surface and a load-bearing receiving surface, said receiving surfaces together forming an exterior corner;

d) a forming tool having a first mounting surface on a first side thereof and an exterior corner defined by first and second corner surfaces on a second side thereof, said first mounting surface being engaged with the first receiving surface of the support plate, the tool having a load-bearing mounting surface forming an included angle with said first mounting surface, said load-bearing mounting surface being adapted to engage the load-bearing surface of the support plate, the tool having a workpiece-deforming surface oriented downwardly toward said forming die; and e) a clamp attached pivotally to the tool holder body and having an engagement portion that is moveable toward said first receiving surface by pivoting the clamp, said engagement portion having therein formed a bore in which an elongated shaft is rotatably received, the engagement portion defining an opening communicating with the bore, the shaft having therein formed a notch that is adapted to be engaged through said opening by said exterior corner of the tool, the notch being configured such that when the engagement portion of the clamp is forced against the tool said first corner surface bears against a first surface portion of the notch and causes the shaft to rotate within the bore, thereby bringing a second surface portion of the notch to bear against said second corner surface and delivering to the tool a mounting force having a component normal to said second corner surface;

wherein said load-bearing surfaces can be engaged with one another by forcing the engagement portion of the clamp against the tool without forcing the workpiece-deforming surface of the tool against the forming die on the lower table.

* * * * *